US012559871B2

(12) United States Patent
Grange et al.

(10) Patent No.: US 12,559,871 B2
(45) Date of Patent: Feb. 24, 2026

(54) SHEDDING MACHINE FOR A LOOM AND SHEDDING ASSEMBLY FOR A LOOM COMPRISING A GROUP OF SUCH MACHINES

(71) Applicant: STAUBLI FAVERGES, Faverges-Seythenex (FR)

(72) Inventors: Hervé Grange, Cesarches (FR); Anthony Boillot, Leschaux (FR); Raphael Peuget, Pontcharra (FR); Laurent Alciato, Val de Chaise (FR)

(73) Assignee: STAUBLI FAVERGES, Faverges-Seythenex (FR)

( * ) Notice: Subject to any disclaimer, the term of this patent is extended or adjusted under 35 U.S.C. 154(b) by 0 days.

(21) Appl. No.: 19/092,912

(22) Filed: Mar. 27, 2025

(65) Prior Publication Data

US 2025/0305189 A1 Oct. 2, 2025

(30) Foreign Application Priority Data

Mar. 28, 2024 (FR) ..... 2403210

(51) Int. Cl.
*D03C 11/00* (2006.01)
*D03D 51/00* (2006.01)
(Continued)

(52) U.S. Cl.
CPC ..... *D03C 11/00* (2013.01); *D03D 51/005* (2013.01); *D03D 51/02* (2013.01)

(58) Field of Classification Search
CPC ..... D03C 11/00; D03D 51/005; D03D 51/02
See application file for complete search history.

(56) References Cited

U.S. PATENT DOCUMENTS 5,857,496 A * 1/1999 Brown ..... D03D 49/04 388/811
6,179,012 B1 * 1/2001 Nowack ..... D03D 51/02 361/243

(Continued)

FOREIGN PATENT DOCUMENTS

EP 0 869 210 A1 10/1998
EP 1 953 276 A1 8/2008

(Continued)

OTHER PUBLICATIONS

Search Report issued in FR 2403210, dated Sep. 4, 2024.

*Primary Examiner* — Robert H Muromoto, Jr.
(74) *Attorney, Agent, or Firm* — MARSHALL, GERSTEIN & BORUN LLP

(57) ABSTRACT

A fluidic connection device, including a flange, and a nozzle through which passes a distal internal channel, and which is configured so as to be fluidically coupled to a complementary connection device. The nozzle, mounted in the flange with the possibility of tilting relative to the flange, includes a rear end, and a front end. The invention also includes a rod including an intermediate internal channel; a front end, mounted in sealed cooperation with the rear end of the nozzle with the possibility of tilting of the rod relative to the nozzle and relative to the flange, for fluidic communication between the distal internal channel of the nozzle and the intermediate internal channel of the rod; and a rear end for fluidic communication between a proximal internal conduit and the intermediate internal channel.

20 Claims, 21 Drawing Sheets

(51) Int. Cl.
*D03D 51/02* (2006.01)
*D03C 13/00* (2006.01)

(56) References Cited

U.S. PATENT DOCUMENTS

| | | | | |
|---|---|---|---|---|
| 6,247,503 | B1 * | 6/2001 | Shaw | D03D 51/02 139/1 R |
| 6,962,171 | B2 * | 11/2005 | Krumm | D03C 1/146 139/1 R |
| 7,730,910 | B2 | 6/2010 | Communal et al. | |
| 8,973,620 | B2 * | 3/2015 | Tardy | D03C 9/0683 74/105 |
| 11,713,521 | B2 * | 8/2023 | Tardy | D03C 1/005 139/55.1 |
| 11,993,870 | B2 * | 5/2024 | Grange | D03C 1/146 |
| 12,091,784 | B2 * | 9/2024 | Tardy | D03C 1/144 |
| 2023/0235488 | A1 | 7/2023 | Tardy et al. | |

FOREIGN PATENT DOCUMENTS

| | | | |
|---|---|---|---|
| EP | 4 144 903 | A1 | 3/2023 |
| EP | 4 219 813 | A1 | 8/2023 |
| EP | 3 711 141 | B1 | 11/2023 |
| FR | 3 004 468 | A3 | 10/2014 |
| FR | 3 132 108 | A1 | 7/2023 |

* cited by examiner

SHEDDING MACHINE FOR A LOOM AND SHEDDING ASSEMBLY FOR A LOOM COMPRISING A GROUP OF SUCH MACHINES

FIELD

The present invention relates to a shedding machine for a loom and a shedding assembly for a loom comprising a group of such machines.

The invention relates to the technical field of shedding machines of the frame connecting rod actuator type, for a heald frame loom.

BACKGROUND

It is known to employ a plurality of electrical frame actuators to drive heald frames in vertical oscillation. According to the technology employed, the electrical actuators produce either oscillating or continuous rotation. In particular, EP4144903A1 and EP4219813A1 describe shedding machines in which each electrical actuator drives the corresponding heald frame by means of a pulling mechanism, comprising a crank pin, connecting rods and levers, which transform the rotation produced by the actuator into a reciprocating movement in translation of the heald frame.

In operation, the motor must stop and restart at high frequency, depending on the desired position of the frame with each stroke of the loom. It is therefore desirable that the rotational inertia of the motor rotor is minimal, to avoid excessive vibration and high energy consumption for these accelerations. In addition, the space available for arranging the motors is relatively small. Consequently, the actuators used in such shedding machine have relatively low torque, due to inertia and dimensional constraints. However, it is desirable for the torque developed by the actuators to be sufficiently high, in order to drive the heald frames, which can be relatively heavy and on which the tensioned warp threads apply forces tending to oppose their displacement. In addition, the speed required to drive the frames is generally less than the rated speed of the motors, so that the motors operate with relatively low efficiency.

It is also known from FR3004468A3 to add a gearbox to the rotor output of a shedding machine motor. In practice, this allows to obtain a higher torque at the output of the gearbox and therefore to adopt an operating regime in which the efficiency of the motor is higher. However, the addition of a gearbox is costly, poses problems of dimension and is not optimal in terms of efficiency either, due to the losses associated with the gearbox. Furthermore, the inertia of the geared motor assembly is greatly increased due to the rotating parts of the gearbox, the rotational inertia of which is added to that of the rotor.

SUMMARY

The aim of the invention is therefore to propose a shedding machine for which the moment of inertia is reduced, without leading to excessive increases in dimension and cost, and without lowering efficiency and rated torque.

To this end, the invention has as its object a shedding machine for actuating a heald frame of a loom according to a reciprocating movement in translation stroke according to a frame axis, the shedding machine comprising:

a rotary electric motor, comprising:

a housing, centered on a main axis of the rotary electric motor and configured to be integral with a machine frame of the loom, a stator, integral with the housing, a rotor, arranged in the stator and comprising a cylindrical part, centered on the main axis and comprising an outer peripheral wall, a first bearing, arranged in a first plane, perpendicular to the main axis, on a front side of the rotary electric motor, and a second bearing, arranged in a second plane, perpendicular to the main axis, on a rear side of the rotary electric motor, the first bearing and the second bearing guiding a rotation of the rotor relative to the stator about the main axis;

a crank, integral with the rotor and comprising a crankpin defining an eccentric axis, parallel to the main axis and distant from the main axis by an eccentric center distance;

a drive lever, which is configured to pivot about a first lever axis relative to the machine frame, to actuate the heald frame, the first lever axis being fixed relative to, and parallel to, the main axis; and a drive connecting rod, which comprises:

a first end, coupled to the crankpin and being pivotable about the eccentric axis relative to the crankpin, and a second end, coupled to the drive lever and being pivotable about a second lever axis relative to the drive lever, the second lever axis being parallel to the first lever axis;

wherein:

the stator comprises:

winding laminations, surrounding the main axis and extending radially between an outer stator diameter and an inner stator diameter centered on the main axis, the winding laminations forming winding teeth distributed about the main axis, directed toward the main axis and delimiting between them the stator notches, which extend parallel to the main axis, and electrical windings, each electrical winding being wound about several of the winding teeth and received in the stator slots; and the rotor comprises:

a rotor shaft, centered on the main axis, surrounded by the cylindrical part of the rotor and being integral with the cylindrical part of the rotor and the crank, and permanent magnets arranged on the outer peripheral wall of the cylindrical part and being distributed about the main axis, each permanent magnet comprising a respective outer surface, the outer surfaces facing the winding teeth and being on a rotor circle centered on the main axis and defining a rotor diameter; and a ratio of the outer stator diameter relative to a length of the cylindrical part, measured parallel to the main axis without extending beyond the permanent magnets, is between 2.0 and 4.0, preferably between 2.5 and 3.5, more preferably, between 2.8 and 3.2.

One idea behind the invention is that the rotor comprises, in addition to the cylindrical part, a rotor shaft, which allows the moment of inertia of the rotor to be reduced, compared with the prior art, insofar as a greater proportion of the mass of the rotor is brought closer to the main axis by being concentrated in the rotor shaft rather than in the cylindrical part. Nevertheless, retaining the cylindrical part allows a significant lever arm to be retained so that the electromagnetic field imparted by the stator on the permanent magnets of the rotor, carried by the cylindrical part, allows a relatively high rated torque to be obtained. In addition, retaining the cylindrical part allows to design the rotary electric motor such that the outer stator diameter is relatively large, in particular greater than the length of the cylindrical part, without the increase in the moment of inertia being too great. The ratio between the outer stator diameter and the length of the cylindrical part then gives the rotary electric motor a higher rated torque and a lower rated speed than in the prior art. During operation, the motor can therefore be operated at a speed closer to its rated speed, ensuring maximum efficiency. The crank being directly connected to the rotor shaft, in other words, no mechanical gearbox is provided between the rotor and the crank, the dimensions, rotational inertia and cost are not excessive.

According to other advantageous aspects of the invention, the invention comprises one or more of the following features, taken alone or in any technically possible combination:

The rotor comprises a first set of permanent magnets, comprising 12 to 40 permanent magnets, preferably 30 to 35 permanent magnets, more preferably 30 permanent magnets, equally distributed about the main axis, and the stator comprises 24 to 48 slots, preferably 32 to 40 slots, more preferably 36 slots, equally distributed about the main axis.

The rotor comprises a second set of permanent magnets offset relative to the first set of permanent magnets according to the main axis, each permanent magnet of the second set of permanent magnets being adjacent to one of the permanent magnets of the first set of permanent magnets according to the main axis, and each permanent magnet of the first set of permanent magnets is angularly offset about the main axis relative to the permanent magnet of the second set of permanent magnets adjacent thereto by an angle of 0.5 to 5 degrees, preferably 1 to 2 degrees, more preferably 1 degree.

The outer stator diameter measures between 160 and 200 mm, preferably between 170 and 190 mm, more preferably between 175 and 185 mm.

The rotor is designed so that a moment of inertia of the rotor is less than 100 $kg \cdot cm^2$, preferably less than 90 $kg \cdot cm^2$, more preferably less than 80 $kg \cdot cm^2$.

The shedding machine comprises an electrical cabinet, comprising an electrical power circuit configured to supply electrical power to the rotary electric motor and in that the rotary electric motor develops a nominal torque of between 30 and 100 Nm, preferably between 50 and 70 Nm, more preferably between 60 and 70 Nm.

The electrical power circuit delivers a supply current I to the rotary electric motor, which develops a torque ratio per unit current I of between 6.5 and 8 Nm/A, preferably between 7 and 7.5 N·m/A, when the speed of rotation of the rotor is maintained at 750 rpm.

It is provided that (i) each winding tooth comprises:

a tooth head, delimited by the inner diameter of the stator, a tooth root, delimited by the outer diameter of the stator, and a tooth body, which extends perpendicularly to the main axis, which connects the tooth head to the tooth root and presents a generally rectangular shape in projection in the first plane, each tooth body having a length, measured radially relative to the main axis, of between 19 and 25 mm, preferably between 20 and 23 mm, more preferably between 21 and 23 mm; and that (ii) each electrical winding forms three layers of wire about the winding tooth about which said electrical winding is wound.

The rotor shaft comprises a single piece which extends so as to connect the first plane and the second plane.

The rotor comprises a disk, extending perpendicularly to the main axis, comprising recesses distributed about the main axis and a central bore, by means of which the disk is fitted onto the rotor shaft, and the cylindrical part is integral with the rotor shaft and the disk and surrounds the disk.

The rotor shaft comprises a centering wall, cooperating with the central bore to center the disk on the rotor shaft, and a collar, extending radially to the main axis and being arranged between the first plane and the second plane, the disk being fixed to the collar by means of at least one screw parallel to the main axis.

It is provided that (i) the crank comprises:

a base, integral with the rotor shaft, and a connecting piece, integral with the crank pin and mounted on the base; and that (ii) the shedding machine comprises an adjustment system, which comprises locking means, configured to:

allow adjustment of the eccentric center distance, by relative displacement between the base and the connecting piece, in an adjustment configuration of the adjustment system, and secure the base to the connecting piece in a locked configuration of the adjustment system.

The base comprises a cam groove, defining a spiral about the main axis, and the connecting piece comprises a follower finger circulating along the cam groove to guide the connecting piece relative to the base when the adjustment system is in an adjustment configuration and thus vary the eccentric center distance.

The connecting piece and the base are pivotable relative to each other about a crank axis parallel to the main axis, when the adjustment system is in the adjustment configuration.

It is provided that (i) a rotation stroke without change of direction of the rotor about the main axis corresponds to an oscillation stroke of the drive lever about the first lever axis, the oscillation stroke including a high frame orientation, a crossover orientation and a low frame orientation of the drive lever, the crossover orientation being median between the high frame orientation and the low frame orientation; and that (ii) the rotary electric motor comprises locking means, which allows:

a locked configuration, in which the locking means immobilizes the rotor relative to the stator about the main axis, selectively according to several predetermined reference orientations, of which:

a shed amplitude adjustment orientation, in which the drive lever is in the high frame orientation or in the low frame orientation, and a shed height adjustment orientation, at 90 degrees relative to the shed amplitude adjustment orientation, and in which the drive lever is in the crossover orientation; and a release configuration, in which the locking means allows rotation of the rotor about the main axis relative to the stator.

The locking means comprises a locking pin, movable relative to the stator according to a direction parallel to the main axis, a first notch, belonging to the rotor and cooperating with the locking pin in the locked configuration, for immobilizing the rotor in the shed amplitude adjustment orientation, and a second notch, belonging to the rotor and cooperating with the locking pin in the locked configuration, to immobilize the rotor in the shed height adjustment orientation.

The shedding machine is arranged so that, when the rotary electric motor is in the locked configuration with the rotor in the shed amplitude adjustment orientation, then the main axis, the eccentric axis and the second lever axis are substantially coplanar.

The shedding machine comprises:

- a front flange, integral with the housing and comprising a circular flange, configured to cooperate with the machine frame, so that the housing can be positioned on the machine frame;
- means for securing the rotary electric motor to the machine frame, for fixing the rotary electric motor to the machine frame when the circular flange cooperates with the machine frame; and
- an indexing means, which is distinct from the fixing means and requires that, when the circular flange cooperates with the machine frame, the casing is positioned so that:
  - the drive lever is in the high frame orientation or in the low frame orientation when the rotor is in the shed amplitude adjustment orientation in the locked configuration, and
  - the drive lever is in the crossover orientation when the rotor is in the shed height adjustment orientation in the locked configuration.

The first lever axis and the second lever axis are connected by a lever arm straight line perpendicular to the second lever axis; the eccentric axis and the second lever axis are connected by a drive connecting rod straight line perpendicular to the second lever axis and defining a drive connecting rod lever angle with the lever arm straight line; and the drive connecting rod lever angle is 97 degrees, plus or minus 2 degrees, when the drive lever is in the crossover orientation.

The invention also has as its object a shedding assembly, comprising a group of shedding machines such as defined above and in which:

- each shedding machine of the group defines a lever arm distance, measured between the first lever axis and the second lever axis;
- the lever arm distance of each shedding machine in the group is equal to the lever arm distance of every other shedding machine in the group; and
- when the shedding machines in the group are in a locked configuration with the rotor in one of the reference orientations, then the respective main axes, eccentric axes and second lever axes of the shedding machines in the group are coplanar.

BRIEF DESCRIPTION OF THE DRAWINGS

The invention will become clearer from the following description, given by way of non-limiting example only and made with reference to the appended drawings in which.

DETAILED DESCRIPTION

Figure 1:
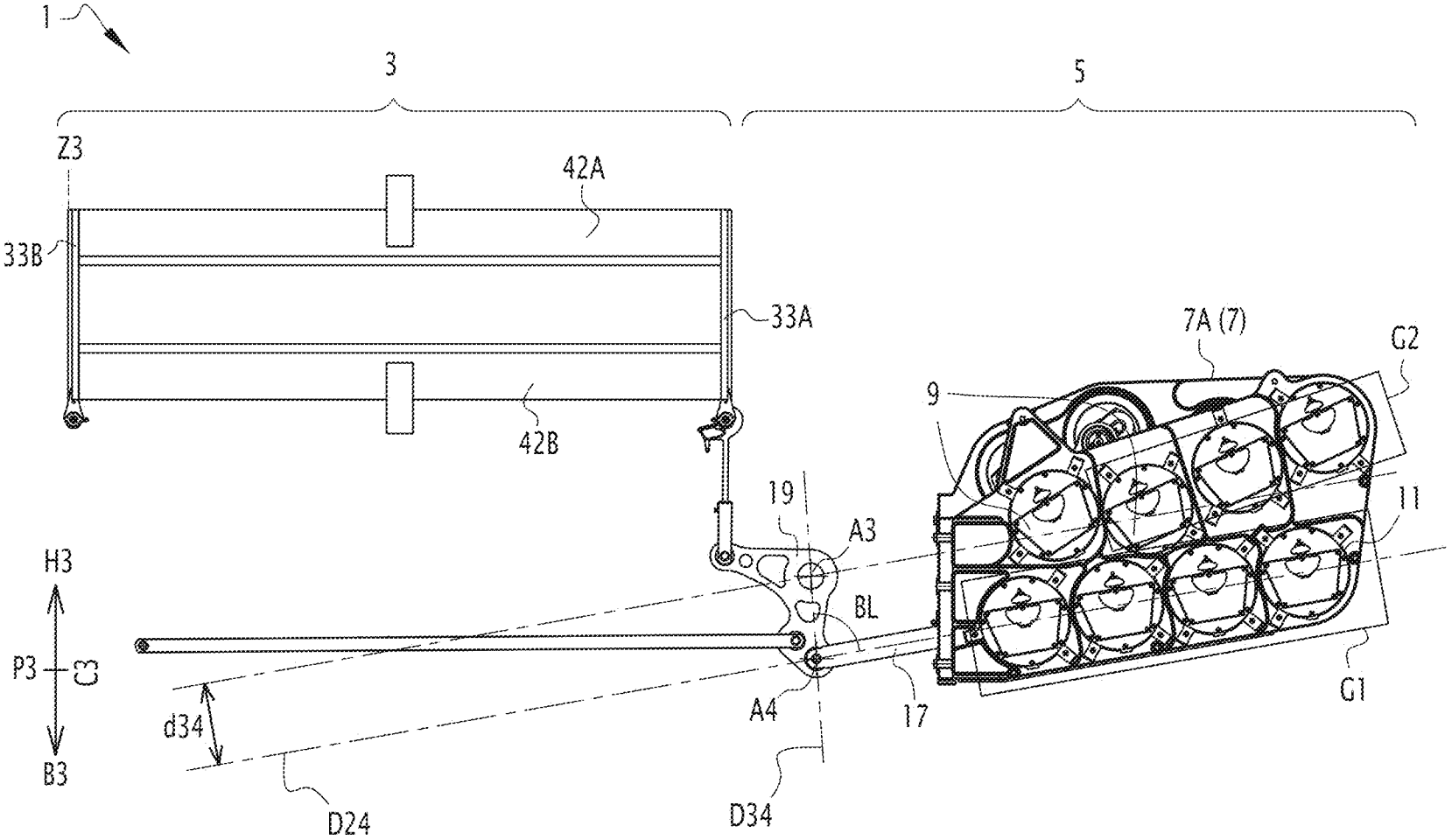
FIG. 1 is a side view of a shedding assembly comprising several groups of shedding machines mounted on a machine frame, according to a first embodiment of the invention, a drive lever and a drive connecting rod belonging to one of the shedding machines and driving a heald frame being shown, the drive lever being of a first type.
Figure 2:
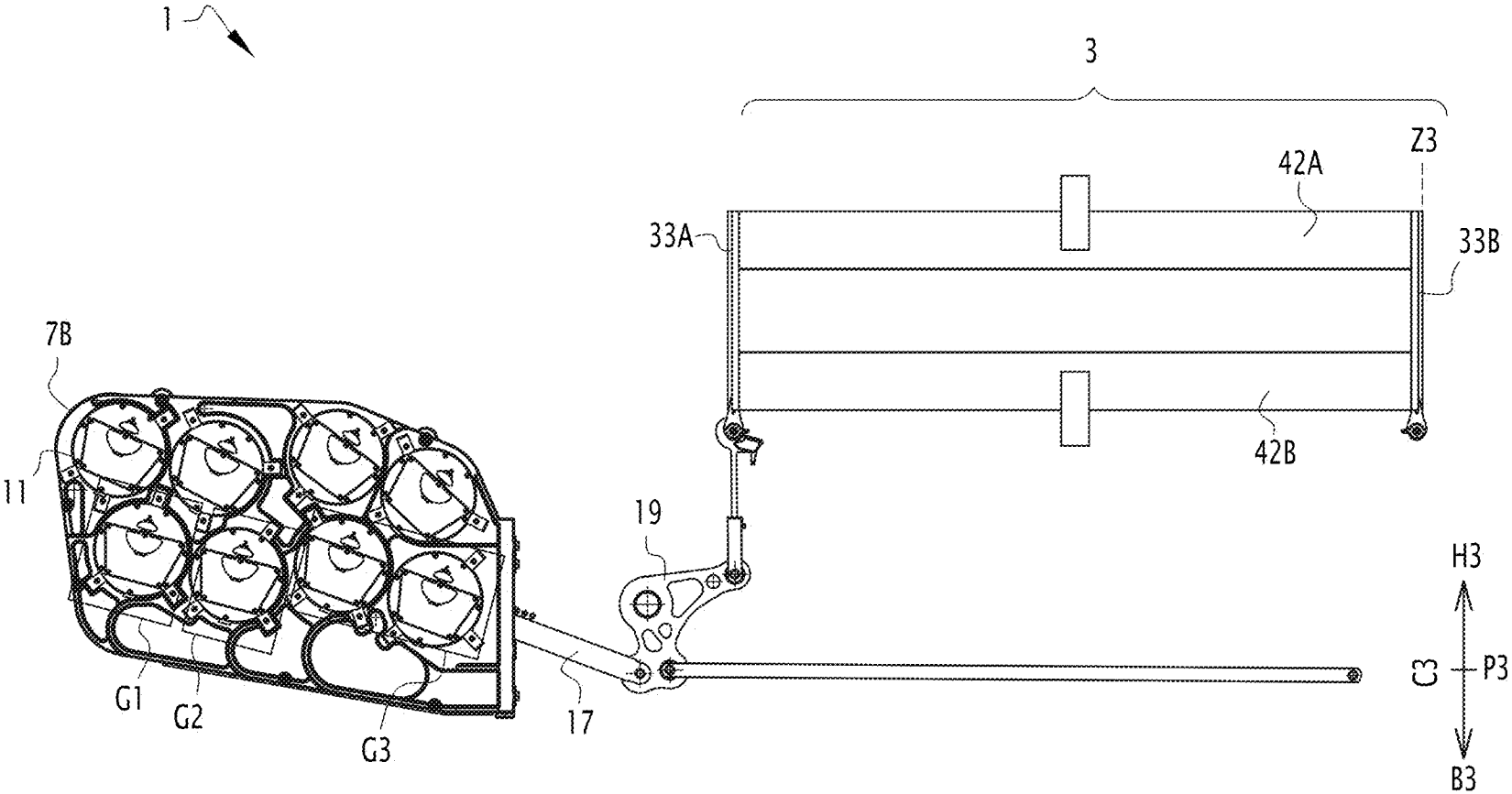
FIG. 2 is a view from an opposite side of the shedding assembly of FIG. 1, with a drive lever and a drive connecting rod belonging to another of the shedding machines and driving another heald frame being shown, the drive lever being of a second type.

Consider a loom 1, partially represented in FIGS. 1 and 2, according to a first embodiment of the invention. The loom 1 comprises heald frames 3 and a shedding assembly 5 serving to actuate the heald frames 3.

The shedding assembly 5 comprises a frame 7, fixed in the terrestrial reference frame, and the shedding machines 9. Only one heald frame 3 is represented in each of FIGS. 1 and 2. The shedding machines 9 are partially represented, except for the one operating this frame 3, which is represented in its entirety.

Here, sixteen shedding machines 9 and sixteen heald frames 3 are provided, each shedding machine 9 actuating one of the heald frames 3. Alternatively, the same shedding machine 9 can actuate several heald frames 3. The heald frames 3 are superimposed according to a direction perpendicular to the heald frames 3 and offset from one another by a distance of around 12 mm according to this direction, for example.

Each heald frame 3 advantageously comprises an upper crossmember 42A, a lower crossmember 42B, parallel to the crossmember 42A, and two uprights 33A and 33B, parallel to each other and connecting the crossmembers 42A and 42B. Preferably, the crossmembers 42A and 42B are horizontal, while the uprights 33A and 33B are vertical. The crossmembers 42A and 42B are approximately 2 m long. Each heald frame 3 is equipped with a row of healds, not represented, each connecting the crossmembers 42A and 42B and being arranged between the uprights 33A and 33B, being distributed along the crossmembers 42A and 42B. The healds each carry an eyelet through which a warp thread passes, the warp threads forming a warp thread ply. For example, each heald frame 3 has a mass of around 7 kg and is subject to warp thread tension forces adding an equivalent load of around 50%. The loom 1 advantageously includes other components, such as a batten, weft insertion means, a weft feeder, which are not represented.

For the purpose of weaving, each shedding machine 9 is designed to actuate the corresponding heald frame 3 according to a reciprocating translation stroke C3, relative to the frame 7, according to a frame axis Z3 specific to this frame 3. The term "stroke" refers to the path travelled by the heald frame 3 during its displacement. Being displaced by the machine 9 along the stroke C3, the heald frame 3 is displaced parallel to axis Z3, according to a rectilinear movement, moving back and forth between an upper end position H3, corresponding to an upper limit of the stroke C3, and a lower end position B3, corresponding to a lower limit of the stroke C3. For example, the stroke C3 has a reference amplitude of the order of 100 mm, this amplitude being advantageously adjustable, as explained below. The axis Z3, and therefore the displacement of the frame 3, is preferably vertical, or at least parallel to the heald frame 3 under consideration. The reference position P3 is defined as being a central position, which may correspond to the crossover position of the loom 1 for all the warp yarn layers the stroke of which are centered relative to a central plane comprising the heald eyelets of the frames in position P3.

During weaving, for the insertion of each weft thread, the position of the frames 3 along their respective stroke C3 is determined by the action of the machines 9, independently for each frame 3, to define the shed of the loom 1 receiving the inserted weft thread. The loom 1 then produces a fabric of warp and weft threads with a desired weave.

The frame 7 is preferably an assembly of welded or otherwise assembled parts, fixed relative to the ground and arranged at one end of the heald frames 3. The frame 7 comprises two parts 7A and 7B, the part 7A being best seen in FIG. 1 and the part 7B being best seen in FIG. 2. The parts 7A and 7B are arranged parallel relative to each other and to the heald frames 3 and face each other. Each part 7A or 7B comprises locations 11, each location 11 receiving one of the shedding machines 9, which is thus fixed to the frame 7. Here, each sub-assembly 7A or 7B comprises eight locations 11, respectively receiving eight of the machines 9.

Figure 3:
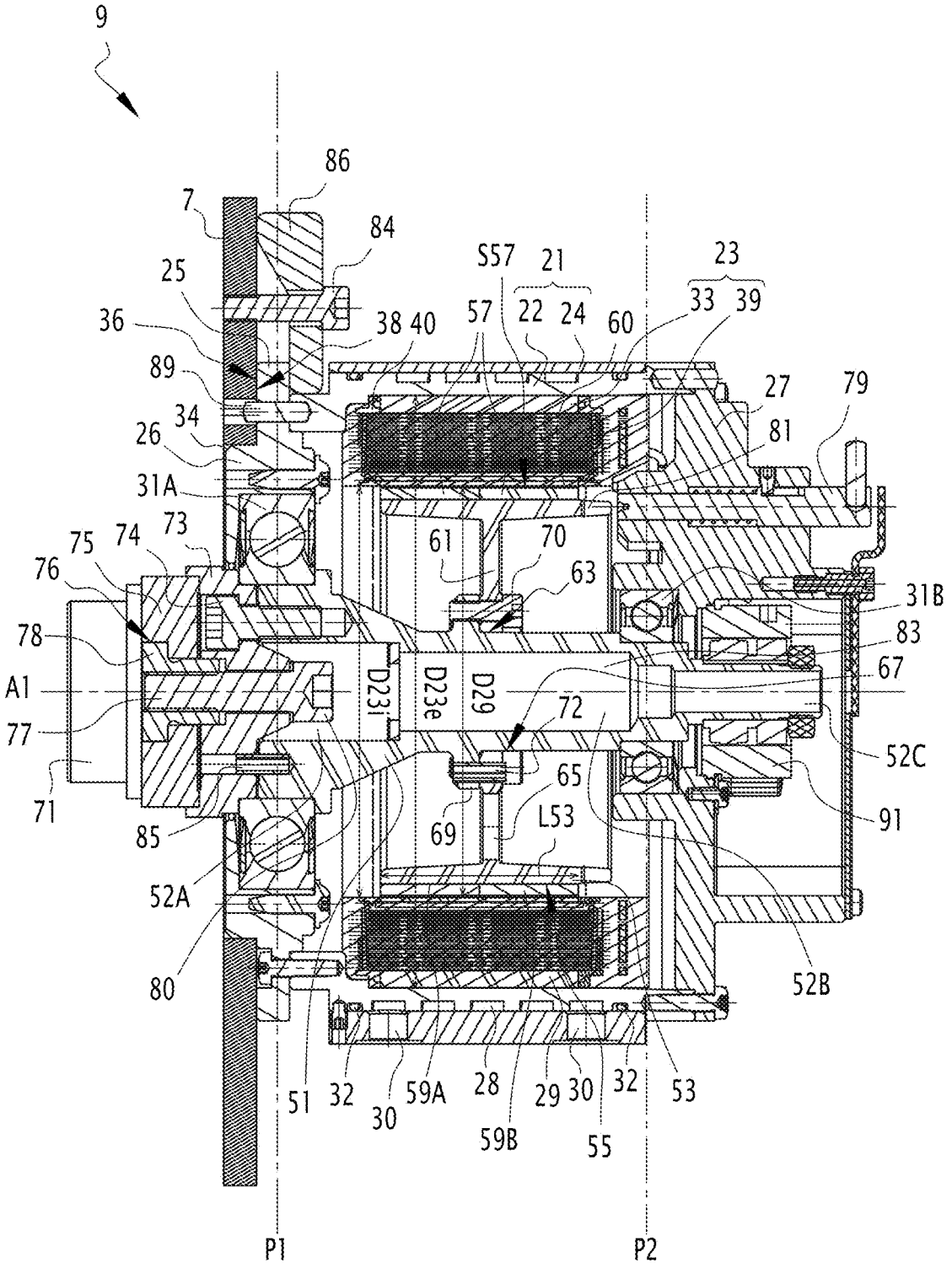
FIG. 3 is a longitudinal sectional view of one of the shedding machines of FIGS. 1 and 2, centered on a main axis belonging to the rotary electric motor of this shedding machine.
Figure 4:
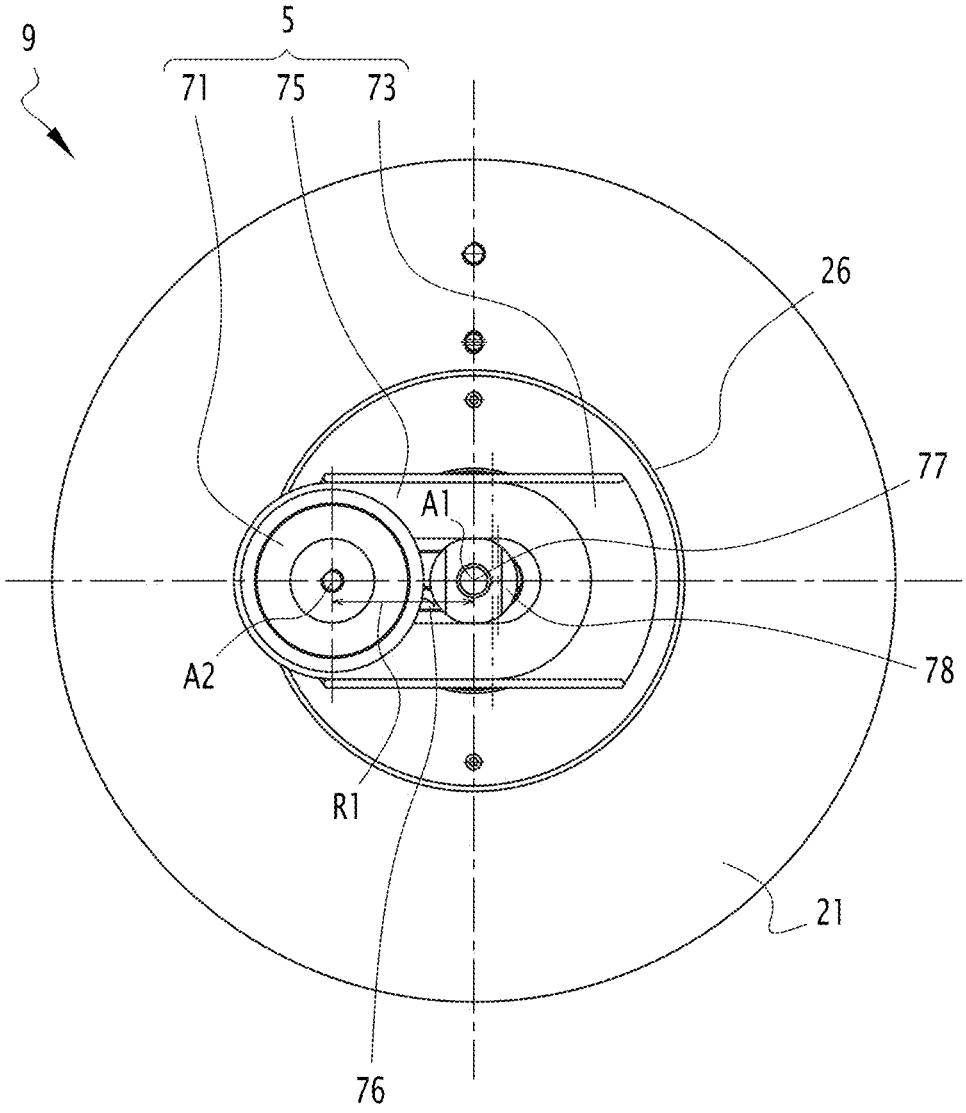
FIG. 4 is a partial front view of the shedding machine of FIG. 3, in which the drive connecting rod is omitted.

Each shedding machine 9 comprises a rotary electric motor 13 and a crank 15, visible in greater detail on FIGS. 3 and 4, as well as a drive connecting rod 17 and a drive lever 19, visible on FIGS. 1 and 2, by means of which the motor 13 actuates the frame 3. The rotary electric motors 13 and the cranks 15 of the sixteen shedding machines 9 are advantageously identical to each other, or substantially similar relative to each other.

Each shedding machine 9 preferably includes an adjustment system allowing to set, on the one hand the shed height, in other words, the reference position P3 relative to the ground, and on the other the shed amplitude, in other words, the amplitude of the stroke C3, in other words, the distance between the upper end position H3 and the lower end position B3 assumed by the heald frame 3 when it is driven by the rotary electric motor 13.

Each rotary electric motor 13 is preferably controlled by a microcontroller contained in a control cabinet, not represented. The control cabinet comprises, for example, a central unit, itself comprising a master controller, which exchanges data with each microcontroller of each shedding machine 9. The loom 1, advantageously comprises a terminal allowing a weaver to apply different settings to the loom 1, depending on the desired weaving articles. In practice, the weaver selects a program for weaving an article via the terminal, with a predetermined weave, speed and profile. This setpoint is transmitted to the central unit, which converts them into position setpoints for the rotating electric motors 13 of each shedding machine 9. The position setpoints are transmitted to the associated microcontroller and then to the rotary electric motor 13 by means of an electrical power circuit.

As clearly visible in FIGS. 3 and 4, the rotary electric motor 13 comprises a housing 21, a stator 23, a rotor 29, a first bearing 31A and a second bearing 31B. A first plane P1, in which the first bearing 31A extends, and a second plane P2, in which the second bearing 31B extends, are defined.

The rotary electric motor 13 is a permanent magnet synchronous motor, the structure of which is detailed below. The choice of this motor technology combines several advantages for the application, notably a precise speed and torque control offering fine control of the frame 3, of simplified construction and maintenance thanks to the fact that the rotor 29 has no windings, as well as the ability to maintain high torque even at low speeds, which allows to dispense with a gearbox between the rotor 29 and the crank 15.

The housing 21 constitutes the interface of the rotary electric motor 13 relative to the frame 7 and is fixed to one of the locations 11. The housing 21 is centered on a main axis A1 of the motor 13, which is perpendicular and fixed relative to the frame axis Z3.

Advantageously, the housing 21 includes an inner peripheral part 22, an outer peripheral part 24, a front flange 25 and a rear flange 27. The inner peripheral part 22 surrounds the main axis A1 and is secured to the front flange 25 and the rear flange 27. The flanges 25 and 27 are perpendicular to the main axis A1 and close the axial ends of the inner peripheral part 22. The outer peripheral part 24 envelops the inner peripheral part 22.

The parts 22 and 24 advantageously delimit between them a helical channel 28, centered on the axis A1, constituting a cooling circuit, designed to guide the circulation of a coolant through the thickness of the housing 21, to cool the motor 13. The outer peripheral part 24 includes two radial channels 30 fluidly connected to respective ends of the helical channel 28, respectively for supplying the helical channel 28 with coolant and discharging the coolant from said helical channel. The housing 21 preferably includes two seals 32, radially interposed between the inner peripheral part 22 and the outer peripheral part 24, being arranged axially on either side of the channels 28 and 30, in order to contain the coolant inside the housing 21. The radial channels 30 are connected to a cooling circuit, preferably common to all the machines 9, which comprises tubes, a pump for circulating the coolant in the cooling circuit, a heat dissipation device and a tank.

Advantageously, the front flange 25 is fixed by screws to the inner peripheral part 25. The front flange 25 comprises a circular flange 26, cooperating with the frame 7, allowing the housing 21 to be positioned on the frame 7. In particular, at the location 11, the frame 7 forms a circular opening 34 complementary to the circular flange 26, and which coaxially receives the circular flange 26, without constraining the orientation of the circular flange 26, and therefore of the housing 21, about the axis A1, relative to the frame 7. The housing 21 also comes to bear forward according to the axis A1 against the frame 7, by bringing a bearing face 36 of the front flange 25 into contact against a corresponding face 38 of the frame 7, surrounding the circular opening 34, at the location 11. The machine 9 also comprises an indexing means, allowing the orientation of the housing 21 relative to the frame 7 to be imposed about the axis A1. For example, the indexing means includes an indexing pin 89, which is received both in an opening formed in the front flange 25, parallel to and at a distance from the axis A1, and in a corresponding opening formed at location 11 of the frame 7, formed at the periphery of the circular opening 34. The indexing means can be considered as a rotational encoder, imposing a single orientation of the housing 21 relative to the frame 7 about the axis A1. This allows to position the motor 9 in a particular position in which the mechanical efficiency of the transmission formed by the crank 15, the drive connecting rod 17 and the lever 19 is optimal, and in which these elements take up a particular position facilitating adjustment of the height of the shed or amplitude of the shed, as will be explained later.

Figure 6:
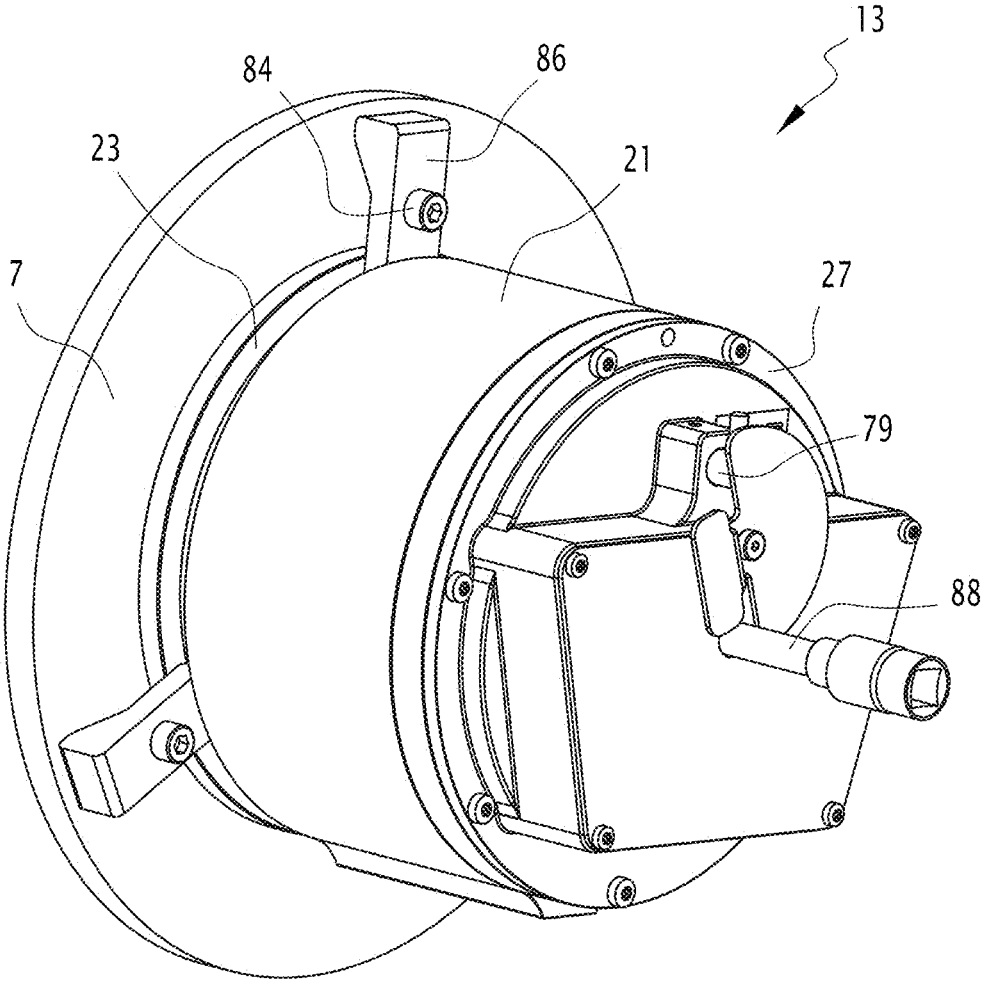
FIG. 6 is a perspective view of a rear side of the shedding machine of FIGS. 3 to 5, with the adjustment tool of FIG. 5, the shedding machine being in a locked configuration and being mounted on the machine frame.

In addition to the above-mentioned indexing means, the machine 9 comprises fastening means, also clearly visible in FIG. 6, for fixing the motor 13 to the frame 7. For example, the fastening means is constituted of the screws 84, which pass through a screw flange 86 belonging to the housing 21 and are screwed into the frame 7 to fix the motor 13 to the frame 7.

Figure 7:
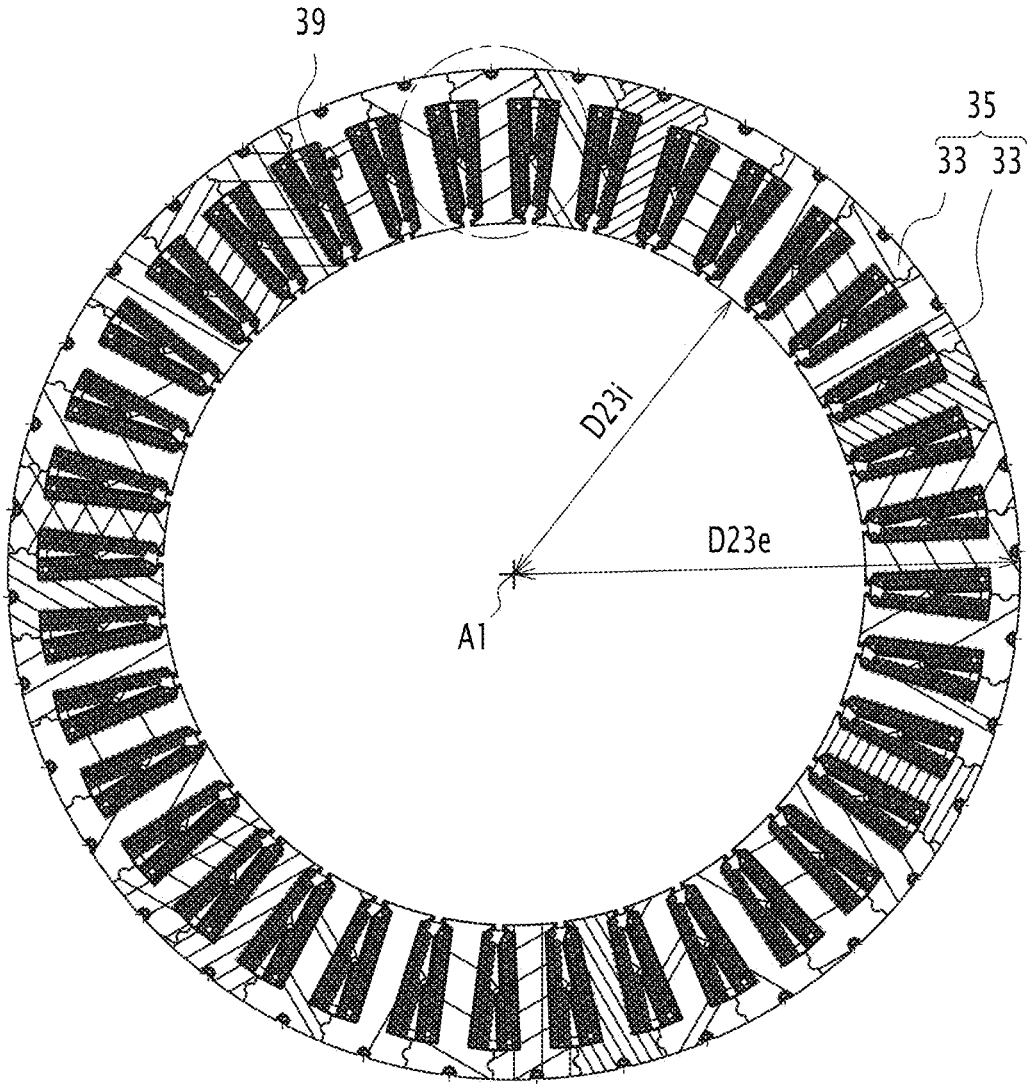
FIG. 7 is a cross-sectional view of a stator of the rotary electric motor of the preceding figures.
Figure 8:
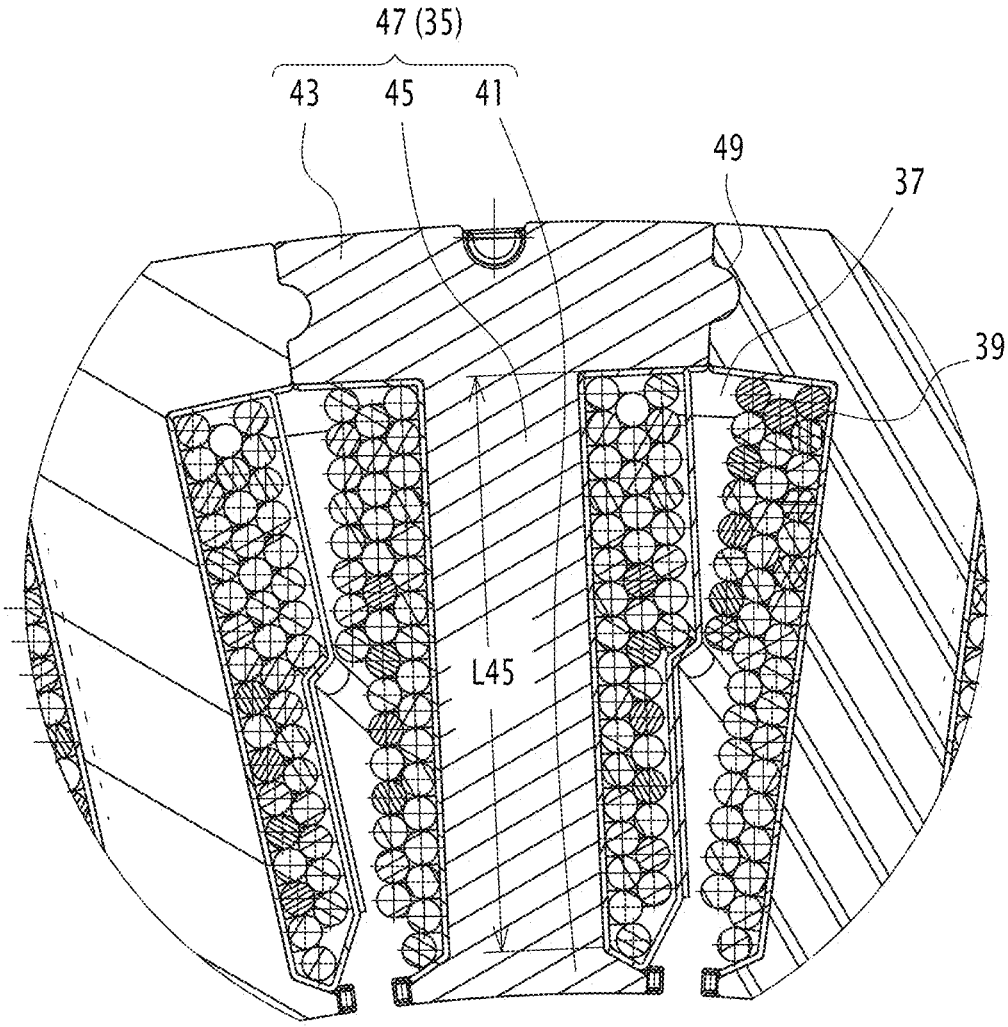
FIG. 8 shows detail B of FIG. 7.

The stator 23, visible in FIG. 3 and shown individually in FIGS. 7 and 8, is fixed securely to the housing 21, being enclosed within the housing 21. Together with the housing 21, the stator 23 represents the fixed part of the rotary electric motor 13. The function of the stator 23 is to generate a magnetic field when the rotary electric motor 13 is supplied by the aforementioned power circuit from the control cabinet.

To this end, the stator 23 comprises winding laminations 33, winding teeth 35 and electrical windings 39, as well as, preferably, two plastic end caps 40.

The winding laminations 33, visible in FIGS. 3 and 7, each present the shape of a ring surrounding the main axis A1. Each winding lamination 33 is flat in shape, perpendicular to the main axis A1. The winding laminations 33 are stacked according to the main axis A1 to form a ferromagnetic core of the motor 13, of tubular shape about the main axis A1. The stator 23 is fixed to the inner part 24 of the housing 21 by means of the laminations 33. Each winding lamination 33 extends radially between an outer stator diameter D23*e* and an inner stator diameter D23*i*, centered on the main axis A1.

The two plastic end caps 40 are positioned respectively at each axial end of the winding core constituted by the winding laminations 33.

Advantageously, and as represented in FIG. 8, each winding lamination 33 is constituted of a number of contiguous tooth plates 47, oriented radially and equally distributed about the main axis A1. Each tooth plate 47 includes a relief 49 cooperating with a complementary relief of the adjacent tooth plate 47 belonging to the same lamination 33, said reliefs positioning the adjacent tooth plates 47 relative to each other. Thus, the manufacture of the stator 23 is simplified and optimizes the quantity of material used, in particular relative to machining a block, which would require a longer manufacturing time and result in material losses due to the removal of a central part.

The winding teeth 35, one of which is shown in greater detail in FIG. 8, are formed by the winding laminations 33. Each winding tooth 35 is formed by the stacking of several tooth sheets 47 aligned according to the main axis A1. Each tooth plate 47 belongs to a single winding tooth 35. The tooth plates are advantageously made of steel.

The winding teeth 35 are directed toward the main axis A1. The teeth 35 delimit between them the stator notches 37, which extend parallel to the main axis A1 and are open in the direction of the main axis A1. Each notch 37 is delimited between two successive teeth 35, by these two teeth 35. Advantageously, each winding tooth 35 comprises a tooth head 41, delimited by the inner stator diameter D23*i*, a tooth root 43, delimited by the outer stator diameter D23*e*, and a tooth body 45, extending perpendicularly to the main axis A1, which connects the tooth head 41 to the tooth root 43. The stator notch 37 is formed between the two adjacent tooth heads 41. As can be seen in FIG. 8, the tooth body 45 presents a generally rectangular shape when projected in a transverse plane of the stator 23. The tooth body 45 also presents a length L45, measured radially relative to the main axis A1, of between 19 and 25 mm, preferably between 20 and 23 mm, even more preferably between 21 and 23 mm.

Advantageously, the outer stator diameter D23*e* measures between 160 and 200 mm, preferably between 170 and 190 mm, even more preferably between 165 and 185 mm. Advantageously, the use of a motor with a large outer stator diameter D23*e* allows the realization of an electromagnetic circuit that exploits the distance to the main axis A1 of the motor 13, and favors the application of a lever arm of the driving force of the rotor 51 by the stator 37 over a high distance. In other words, the outer stator diameter D23*e* imparts a high torque rating to the motor 13 of the shedding machine. Advantageously, the stator notches 37 are 24 to 48 in number, preferably 32 to 40, more preferably 36, and are evenly distributed about the main axis A1. Advantageously, the stator notches 37 have a width of 5.5 mm, measured orthoradially, and a height of 22.1 mm, measured radially.

These dimensions allow an optimum compromise between the torque of the rotary electric motor 13 and its overall dimensions.

Each electrical winding 39 is wound around the winding teeth 35 and being received in the stator notches 37. Advantageously, there are three electrical windings 39, each of which is wound around ten winding teeth 35 equally distributed around the main axis A1. The plastic end caps 40 mechanically protect the electrical windings 39 as they are wound, in order that they are not cut by the laminations 33 at the axial ends of the core. Each electrical winding 39 forms three layers. Among these three layers, the first layer advantageously has 17 turns of conductive wire, around the winding tooth 35 around which said electrical winding 39 is wound. The second layer preferably has 15 turns of conductive wire. The third layer preferably has 8 turns of conductive wire. In this way, the length of wire used is optimized to obtain a magnetic field, and therefore electromagnetic torque, sufficient for the application, while limiting heat dissipation along the wire, in order to improve the efficiency of the rotary electric motor 13. The diameters of the wires are preferably chosen in the order of 1.12 mm, which is also compatible with expected performance while minimizing heating of the stator 29 thanks to sufficient heat dissipation in the stator notches 37.

The motor 13 advantageously comprises a terminal block, not represented, integral with the housing 21, to which the windings 39 are electrically connected. The terminal block allows the motor 13 to be electrically connected to the aforementioned power circuit coming from the control cabinet. When the motor 13 is powered, an electrical current flowing through the windings 39 generates the magnetic field.

Figure 9:
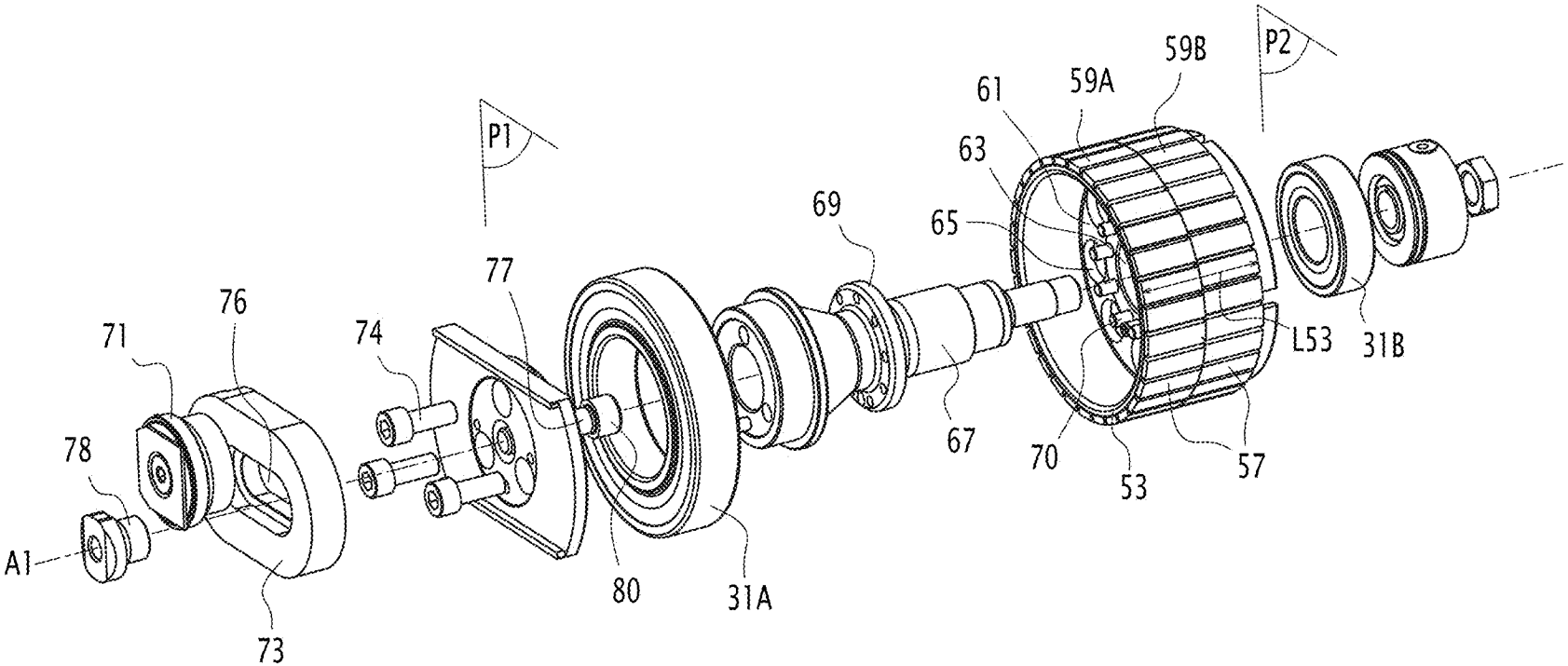
FIG. 9 is an exploded perspective view of a part of the rotary electric motor and part of a crank belonging to the shedding machine of the preceding figures.

As shown in FIGS. 3 and 9, the bearings 31A and 31B are coaxial with the axis A1 and are mounted in the stator 23. In particular, the bearing 31A is mounted on the front flange 25 and the bearing 31B is mounted on the rear flange 27. The first bearing 31A, located on the front side where the motor 13 is loaded, is approximately twice as large as the second bearing 31B, in order to support greater dynamic forces on the front side of the motor 13. Preferably, the first plane P1 and the second plane P2 are less than 120 mm apart.

The rotor 29 is arranged in the stator 23 and is pivotally mounted relative to the stator 23 about the main axis A1 by means of the bearings 31A and 31B. The rotor 29, visible in particular in FIGS. 3 and 9, is arranged in the stator 23 and comprises a rotor shaft 51, a cylindrical part 53 and the permanent magnets 57. The rotor shaft 51 is centered on the main axis A1 and is received in the bearings 31A and 31B, at the ends of the rotor shaft 51. In particular, the rotor shaft 51 passes through each of the two bearings 31A and 31B. The rotor 29 is therefore guided in rotation by the bearings 31A and 31B by means of the rotor shaft 51. Advantageously, the rotor shaft 51 comprises a single piece, which extends so as to connect the first plane P1 and the second plane P2. In particular, the single piece is received in each of the bearings 31A and 31B. In the present example, the rotor shaft 51 is constituted of this one single piece. This allows to optimize the coaxiality of the rotor 29 and the stator 23, as opposed to a multi-part rotor, which could cause mismatches between said pieces. The use of a single piece also simplifies the assembly of the motor 13 and improves the precision of the rotor 51 guidance relative to the stator 23, in particular to ensure precise positioning of the magnets relative to the stator.

The rotor shaft 51 is generally tubular in shape. Advantageously, more precisely, the rotor shaft 51 comprises three hollow cylindrical enclosures 52A, 52B and 52C which follow one another along the axis A1, giving the shaft 51 its tubular shape. The rotor shaft 51 thus forms an internal duct 83, coaxial with the axis A1, extending from one end of the shaft 51 to the other. The internal duct 83 is formed here by the successive cylindrical enclosures 52A, 52B and 52C. The overall envelope of the rotor shaft 51 preferably extends inside a virtual cone, centered on the axis A1 and the apex of which is directed toward the rear of the motor 13, the cone passing successively through the balls of the bearing 31A and the bearing 31B. The shaft 51 being tubular and hollow, its inertia is minimized by an overall envelope close to the axis A1.

The cylindrical part 53 surrounds the rotor shaft 51, being coaxial with the latter and with the main axis A1. The cylindrical part 53 and the rotor shaft 51 are securely fixed to each other, so that the rotor shaft 51 can be driven in rotation about the axis A1 relative to the stator 23, by rotating the rotor 29 by means of the cylindrical part 53.

As clearly visible in FIG. 9, the rotor 29 preferably comprises a disk 61, by means of which the cylindrical part 53 is integral with the main shaft A1. The disk 61 is arranged between the planes P1 and P2.

Preferably, the disk 61 is integral with the cylindrical part 53, forming a single piece with the cylindrical part 53. Otherwise, the disk 61 can be a piece assembled with the cylindrical part 53. Preferably, the disk is arranged between the axial ends of the cylindrical part 53, so that the cylindrical part 53 and the disk have a "T"-shaped longitudinal section.

Preferably, the disk 61 is integral with the rotor shaft 51 by being pressed onto the rotor shaft and fixed in rotation around the rotor shaft 51. For this purpose, the disk 61 is advantageously pressed onto the rotor shaft 51 between the planes P1 and P2, so as to pass through the rotor shaft 51 by means of a central bore 63 in the disk 61. The rotor shaft 51 comprises a centering wall 67, which here is an outer radial wall, cooperating with the bore 63 according to a cylinder-cylinder connection. Advantageously, the rotor shaft 51 comprises a collar 69, which extends radially to the main axis A1 and is arranged between the first plane P1 and the second plane P2. The disk 61 is fixed to the collar 69, for example by means of several connecting screws 70, for example, ten connecting screws 70, parallel to the main axis A1 and distributed around this axis, and several spring pins 72, for example, three. Fixing the disk 61 to the collar 69 fixes the disk 61 in rotation around the rotor shaft 51.

Preferably, the disk 61 comprises recesses 65, for example ten recesses, distributed about the main axis A1. Radially, the recesses 65 are arranged between the cylindrical part 53 and the rotor shaft 51, in particular, between the cylindrical part 53 and the collar 69. Each recess 65 is an opening passing through the disk 61 parallel to the axis A1.

The use of the disk 61 to secure the cylindrical part 53 allows to minimize inertia of the rotor 29, particularly if the disk 61 is equidistant, or almost equidistant, from the planes P1 and P2. Preferably, in order to minimize the rotational inertia, a single disk 61 is provided to connect the cylindrical part 53 to the shaft 51, the cylindrical part 53 and the shaft 51 not being connected other than by the single disk 61. Alternatively, several discs 61 may be provided to connect the cylindrical part 53 to the rotor shaft 51.

The permanent magnets 57 are arranged on an outer peripheral wall 55 of the cylindrical part 53. The outer peripheral wall 55 is advantageously an outer radial surface, centered on the axis A1, which preferably extends from one axial end to the other of the cylindrical part 53, facing the winding laminations 33, over the entire length of the winding teeth 35.

Each permanent magnet 57 comprises a respective outer surface S57, the outer surfaces S57 facing the winding teeth 35 and being on a rotor circle 60 of the rotor, centered on the main axis A1, perpendicular to the axis A1, and defining a rotor diameter D29. Advantageously, the magnets 57 have a length, measured parallel to the main axis A1, of 30 mm, a width, measured orthoradially, of 10.5 mm, and a thickness, measured radially, of 3.5 mm.

A length L53 of the cylindrical portion 53 is defined, which is measured parallel to the main axis A1. The length L53 is measured without passing the permanent magnets 57 in the direction of the axis A1, in other words, in the present example, from a front end of one of the set of permanent magnets 57 arranged at the front of the rotor 29, to the rear end of one of the set of permanent magnets 57 arranged at the rear of the rotor 29.

The rotor 29 is dimensioned so that a ratio of the outer stator diameter D23*e* relative to the length L53 of the cylindrical part 53 is between 2.0 and 4.0, preferably between 2.5 and 3.5, more preferably between 2.8 and 3.2. This dimensioning is optimal for obtaining high torque while minimizing inertia. In other words, this sizing is optimal for ensuring a high energy density of motor 13. The motor torque constant Kt is a torque value obtained per unit of current I delivered by the power circuit. The torque constant Kt is calculated here at a motor speed of 750 rpm, which corresponds to a loom speed of 1500 strokes per minute. Advantageously, the motor 13 develops a torque constant Kt of between 6.5 and 8 Nm/A, preferably between 7 and 7.5 Nm/A. The achievement of such a value of the motor torque constant Kt corresponds to the use of a high-efficiency motor.

Preferably, the outer stator diameter D23*e* is equal to 180 mm and the length L53 is equal to 60 mm. Alternatively, the length L53 is less than 60 mm, and the outer stator diameter D29*e* is adjusted to still obtain the above ratio.

Advantageously, the rotor 29 comprises a first set 59A of permanent magnets 57, comprising twelve to forty permanent magnets 57, preferably thirty to thirty-five permanent magnets 57, more preferably thirty permanent magnets 57, equally distributed about the main axis A1. The permanent magnets 57 of this first set 59A are arranged one after the other about the main axis A1. Preferably, the permanent magnets 57 of this first set 59A are arranged according to a same plane perpendicular to the axis A1. Coupled with the aforementioned dimensions of the stator 23, these dimensions are optimal for maximizing torque while minimizing overall dimensions.

Advantageously, the rotor 29 comprises a second set 59B of permanent magnets 57, offset relative to the first set 59A according to the main axis A1. As with the first set 59A, the magnets 57 of this second set 59B are arranged one after the other about the main axis A1. Preferably, the permanent magnets 57 of this second set 59B are arranged according to the same plane perpendicular to the axis A1, axially offset relative to the plane of the first set 59A. As can be seen in FIG. 9, each permanent magnet 57 of the second set 59B is adjacent to one of the permanent magnets 57 of the first set 59A, according to the main axis A1. Furthermore, each permanent magnet 57 of the first set 59A is angularly offset, about the main axis A1, relative to the permanent magnet 57 of the second set 59B adjacent thereto, for example by an angle of 0.5 to 5 degrees, preferably 1 to 2 degrees, even more preferably 1 degree. Thus, for a given position of the rotor 29 about the axis A1, two permanent magnets 57 belonging to two sets 59A and 59B, different and adjacent to one another and not facing the same portion of the stator 23. This angular offset aims to reduce the occurrence of intermittent jerky movements of the rotor 29, particularly when starting the motor 13, a phenomenon sometimes referred to as notching torque, detent torque or cogging torque, and which applies to motors the rotor of which has permanent magnets. In other words, this angular offset aims to smooth the operation of the motor 13 by reducing torque oscillations. This construction is particularly advantageous, since the present application requires relatively low-speed operation and repeated starting.

Advantageously, the rotor 29 is, in addition, dimensioned in such a way that a moment of inertia of the rotor 29 is less than 100 $kg \cdot cm^2$, preferably less than 90 $kg \cdot cm^2$, most preferably less than 80 $kg \cdot cm^2$. This dimensioning helps to guarantee high torque without excessively increasing the diameter of the rotor, the inertia of which, when too high, is usually detrimental to the dynamic operation of the drive train.

During weaving, the rotor 29 rotates at a speed of about 750 rpm relative to the stator.

Preferably, the rotary electric motor 13 has a rated torque of between 30 and 100 Nm, preferably between 50 and 70 Nm, even more preferably between 60 and 70 Nm. The motor 13 dimensioned as described above has a torque of 65 Nm, up to 93 Nm at peak acceleration, an inertia of 78 $kg \cdot cm^2$ and a rated power of 5.2 kW. The formula for rated power is the torque multiplied by the continuous, uniform angular speed of the motor: $P=C\,\omega$, $\omega=2\pi n/60$, with motor speed n expressed in rpm.

The motor 13 advantageously includes a position sensor 91, for example of the resolver type, a measurement of which reflects the orientation of the rotor 29 about the axis A1, relative to the stator 23. Preferably, the position sensor 91 is arranged at a rear end of the shaft 51. The sensor 91 includes, for example, a fixed part attached to the stator 23 via the flange 27, and a movable part attached to the rear end of the shaft 51. For example, the sensor 91 allows to measure 4096 distinct positions of the rotor 29 about the axis A1 relative to the stator 23. The microcontroller associated with the rotary electric motor 13 determines and supplies the current to the various windings of the stator 23 as a function of the position of the rotor 29, based on the signals from the sensor 91 and the position setpoints.

Figure 5:
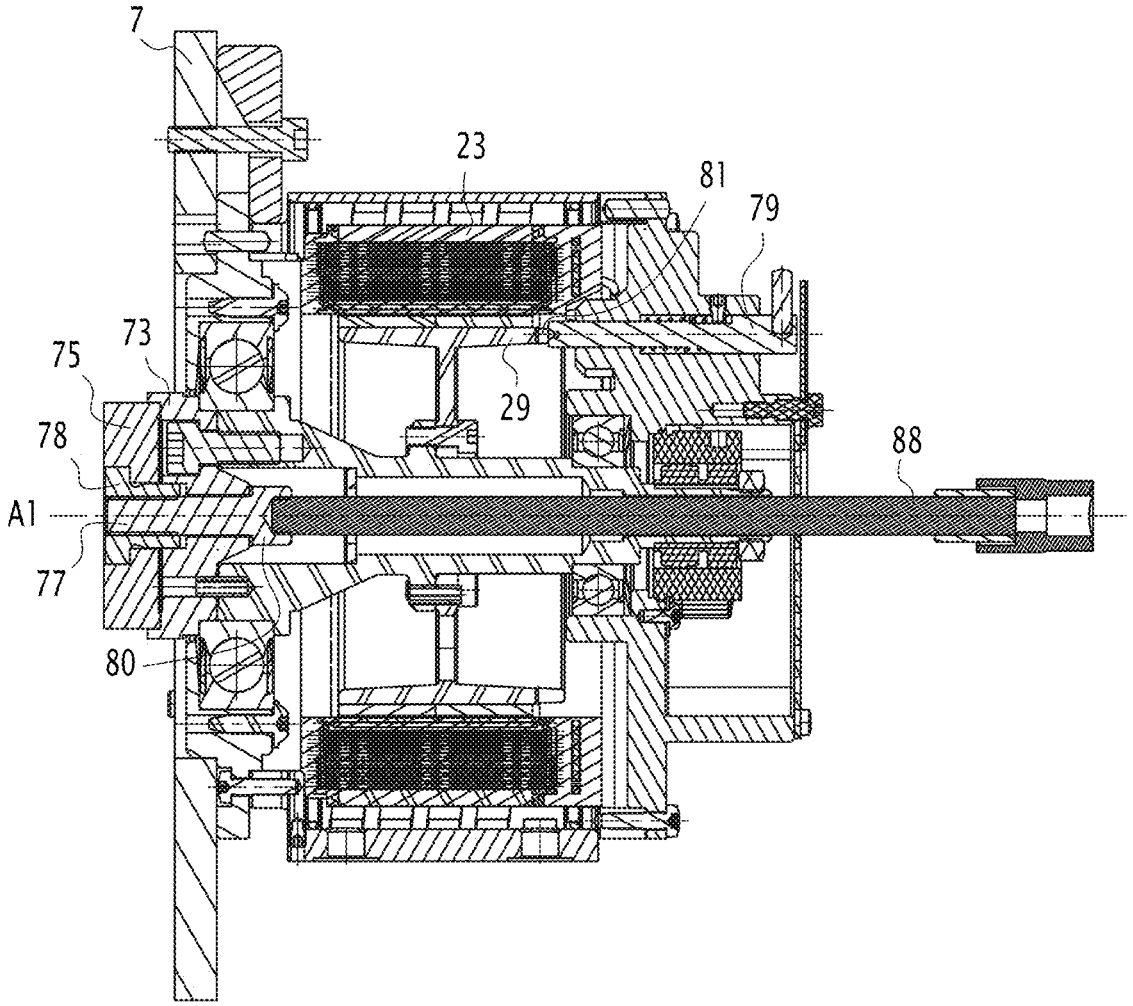
FIG. 5 is a view similar to that of FIG. 3, where the rotary electric motor is in a locked configuration and receives an adjustment tool.

Advantageously, the rotary electric motor 13 also comprises locking means, in this case a locking pin 79 and at least two notches 81 and 82, allowing a locked configuration in which the rotor 29 is immobilized relative to the stator 23 about the main axis A1. The locked configuration is shown in FIG. 5. The locking pin 79 is movable relative to the stator 23 according to a direction parallel to the main axis A1. The first notch 81, belonging to the rotor 29, cooperates with the locking pin 79 in such a way as to immobilize the rotor 29 in a shed amplitude adjustment orientation. The second notch 82, belonging to the rotor 29, cooperates with the locking pin 79 to immobilize the rotor 29 in a shed height adjustment orientation. These particular orientations intervene during shed height and shed amplitude adjustment, which will be described in greater detail below. The configuration in which the locking means allows the rotor 29 to rotate about the stator 23 is referred to as the release configuration. The release configuration is shown in FIG. 3. It is this configuration which is used during weaving. Preferably, the notches 81 and 82 are formed at a rear axial end of the cylindrical part 53. Preferably, the locking pin 79 is mounted through the rear flange 27, so that it can be actuated from outside the motor 13, at the rear of the motor 13, in particular manually.

When the locking pin 79 cooperates with the notch 81 in the locked configuration, the rotor 29 is immobilized in a first orientation relative to the stator 23, known as the "shed amplitude adjustment orientation". When the locking pin 79 cooperates with the notch 82 in the locked configuration, the rotor 29 is immobilized in a second orientation relative to the stator 23, known as the "shed height adjustment orientation". Preferably, the notch 82 is arranged at 90 degrees relative to the notch 81 about the axis A1. The shed height adjustment orientation is therefore at an angle of 90° relative to the shed amplitude adjustment orientation. In practice, four notches are advantageously provided, of which two diametrically opposed notches 81 and two diametrically opposed notches 82, the notches 81 and 82 being spaced 90 degrees apart.

The rotational movement of the rotor 29 thus produced by the rotary electric motor 13 is then converted into the movement in translation of the heald frame 3 by means of a drive connecting rod-crank-lever system, including the crank 15, the drive connecting rod 17 and the drive lever 19.

As clearly visible in FIG. 4, the crank 15 is directly secured to the rotor shaft 51, without any intermediate transmission or gearbox. The crank 15 is arranged at the front of the motor 3. The plane P1 separates the crank 15 from the cylindrical part 53.

The crank 15 comprises a base 73, a connecting piece 75 and a crank pin 71.

The base 73 is integral with the rotor shaft 51, to be driven in rotation by the rotor 29 about the axis A1 relative to the stator 23. For example, the base 73 is fixed to the rotor shaft 51 by means of three spring pins 85 and three connecting screws 74, parallel to the main axis A1 and evenly distributed about this axis A1. A different number of pins 85 and screws 74 can be selected. In the present example, the base 73 forms a radial plate and two rails, forming a sliding guide for the connecting piece 75.

The connecting piece 75 is mounted on the base 73. In this embodiment, the connecting piece 75 is a flange with an axial through slide which is able to slide relative to the base 73, according to a radial direction relative to the axis A1. The connecting piece 75 is received between the rails and bears against the plate of the base 73 to be guided in sliding by the base 73.

The crank pin 71 defines an eccentric axis A2, parallel to the main axis A1 and spaced from the main axis A1 by an eccentric distance R1. The crank pin 71 and the connecting piece 75 are securely fixed to each other.

By sliding the connecting piece 75 and the crank pin 71 relative to the base 73, allows the eccentric distance R1 to be modified.

The connecting piece 75 belongs to an adjustment system of the shedding machine 9, allowing the eccentric center distance R1 to be modified. Indeed, due to the structure of the shedding machine 9, the shed amplitude is directly linked to the eccentric center distance R1. In this case, the greater the distance R1, the greater the stroke amplitude C3, in other words, the greater the distance between the positions B3 and H3. Modifying the eccentric center distance R1 therefore allows the amplitude of the opening of the shed controlled by the heald frame 3 to be modified. For example, it is provided that the distance R1 can be varied from a minimum value of 20 mm to a maximum value of 60 mm, to vary the amplitude of the stroke C3 from a minimum value of 50 mm to a maximum value of 160 mm, when the height of the stroke C3 is centered on the reference position P3, in other words, with the positions B3 and H3 equidistant from the position P3.

The adjustment system also comprises an adjustment screw 77, visible in FIG. 3, able to selectively allow the connecting piece 75 to slide relative to the base 73 and of securing the base 73 to the connecting piece 75. When the adjustment system is in an adjustment configuration, the screw 77 is slackened and sliding is allowed. Conversely, when the adjustment system is in a locked configuration, the adjusting screw 77 is tightened and sliding is impossible. Thus, the eccentric center distance R1 can be adjusted if and only if the adjusting system is in an adjusting configuration and is fixed if the adjusting system is in a locked configuration. During weaving, the adjustment system is in the locked configuration.

As shown in FIGS. 3 and 4, it is advantageously provided that the adjusting screw 77 is coaxial with the axis A1. The adjusting screw 77 includes a body which passes through an oblong hole 76, belonging to the connecting piece 75 and which passes through the connecting piece 75. In the oblong hole 76, a clamping nut 78 is provided, into which the screw 77 is screwed. The screw 77 also includes a head 80, by means of which the screw 77 can be rotated, the base 73 and the connecting piece 75 are axially interposed between the nut 78 and the head 80, so that tightening the screw 77 in the nut 78 presses the connecting piece 75 against the base 73 to prevent sliding. The head 80 is preferably arranged inside the internal duct 83 of the rotor shaft 51. As shown in FIG. 5, the head 80 is thus accessible from the rear of the motor 3, to be actuated using an adjustment tool 88, for example a screwdriver, introduced up to the head 80 from the rear of the motor 13 via the internal duct 83. The screw 77 is chosen to be short, so as to be more resistant to the torsional forces applied by the adjustment tool 88, as well as to minimize the inertia of the rotor 29, in particular relative to a screw the body of which would extend over the entire length of the rotor shaft 51. The envelope of the shaft 51 is brought as close as possible to the axis A1, while leaving a central passage just sufficient to insert the adjustment tool 88.

The drive connecting rod 17 is, at a first end, coupled to the crank pin 71, and pivots about the eccentric axis A2 relative to the crank pin 71, and therefore relative to the crank 15. At a second end, the drive connecting rod 17 is coupled to the drive lever 19, by being pivoted about a lever axis A4 relative to the drive lever 19. The lever axis A4 is parallel to the main axis A1.

A connecting rod center distance R2, is defined as the distance between the lever axis A4 and the eccentric axis A2. Advantageously, the drive connecting rod 17 comprises two telescopic parts, so that the connecting rod center distance R2 can be varied. The aforementioned adjustment system includes a distance R2 adjustment means, allowing a connecting rod center distance R2 adjustment configuration and a connecting rod center distance R2 locked configuration. In the shed height adjustment configuration, sliding between the two parts of the drive connecting rod 17 is possible to vary the connecting rod center distance R2. This has the effect of offsetting the stroke C3 according to the axis Z3 relative to the ground, in other words, adjusting the height of the positions H3, B3 and P3 according to the axis Z3. In the locked configuration, sliding between the two parts is locked, so that the two parts are secured to each other and the connecting rod center distance R2 is fixed, thereby fixing the height of the stroke C3 relative to the ground according to the axis Z3.

The drive lever 19, visible in FIGS. 1 and 2, is pivotable about a lever axis A3 relative to the frame 7. The first lever axis A3 is fixed relative to, and parallel to, the main axis A1. Thus, the pivoting of the drive lever 19 about the axis A3 is subjected by the drive connecting rod 17 to the movement in rotation of the crank 15, and therefore to the rotation of the rotor 29. At its end not coupled to the drive connecting rod 17, the drive lever 19 is coupled to a lower end of the upright 33A of the heald frame 3, which it actuates, preferably via a connecting rod.

By default, the locking system of the rotary electric motor 13 is in the release configuration and the adjustment system is in the locked configuration. During weaving, the micro-controller switches on the rotary electric motor 13, the rotor shaft 51 of which then rotates about the main axis A1. By means of the connecting rod-crank system described above, movement is transmitted to the drive lever 19, which then describes an oscillation stroke about the first lever axis A3, driving the heald frame 3 according to the stroke C3. The oscillation stroke of the drive lever 19 includes a high frame orientation, in which the heald frame 3 is in its high position H3, a crossover orientation, in which the heald frame 3 is in its reference position P3, and a low frame orientation, in which the heald frame 3 is in its low position B3. The drive lever in its high frame orientation 19' and the drive lever in its low frame orientation 19" are represented in FIGS. 10 to 14. The desired movement of the heald frame is thus obtained from the rotary electric motor 13, optimized for the application in terms of torque and dimension.

The above mentioned indexing means, in other words, the indexing pin 89, requires the housing 21 and the locking system to be oriented, about the axis A1 relative to the frame 7, so that the drive lever 19 is in the high frame orientation or in the low frame orientation when the rotor 29 is in the shedding amplitude adjustment orientation in the locked configuration, and that the drive lever 19 is in the crossover orientation when the rotor 29 is in the shedding height adjustment orientation in the locked configuration.

Advantageously, the shedding machine 9 is arranged so that, when the motor 13 is in the locked configuration with the rotor 29 in the shedding amplitude adjustment orientation, then the main axis A1, the eccentric axis A2 and the second lever axis A4 are substantially coplanar. This arrangement is also achieved by the aforementioned indexing means. In other words, the drive connecting rod 17 is substantially positioned in the extension of a sliding direction of the connecting piece 75 relative to the base 73. This particular arrangement allows the eccentric center distance R1 to be adjusted by driving the drive connecting rod 17.

"Substantially coplanar" means that the axes A1, A2 and A4 are not perfectly coplanar. Relative to a perfectly coplanar orientation between a first plane defined by the axes A1 and A2 and a second plane defined by the axes A2 and A4, a tolerance of a few degrees is allowed, for example, for an angle that the first plane would form relative to the second plane.

The first lever axis A3 and the second lever axis A4 are connected by a straight lever arm D34 perpendicular to the second lever axis A4. The eccentric axis A2 and the second lever axis A4 are connected by a connecting rod straight line D24 perpendicular to the second lever axis A4. The connecting rod-lever angle BL is referred to as the angle between the lever arm straight line D34 and the connecting rod straight line D24. Advantageously, the connecting rod-lever angle $\alpha$ is 97 degrees, plus or minus 2 degrees, when the drive lever 19 is in the crossover orientation. Thus, the stroke asymmetry is minimized, and the connecting rod force is optimized.

The aforementioned shedding assembly 5 comprises from one to sixteen groups of shedding machines 9, each group being composed of several shedding machines 9, preferably from two to sixteen shedding machines 9.

In the present example, there are provided on the frame 7 a group G1 of four shedding machines 9 belonging to part 7A and one shedding machine 9 belonging to the part 7B, a group G2 of three shedding machines 9 belonging to the part 7A and one shedding machine 9 belonging to the part 7B, a group G3 of two shedding machines 9 belonging to the part 7B, and five shedding machines 9 which do not belong to any group.

Figure 10:
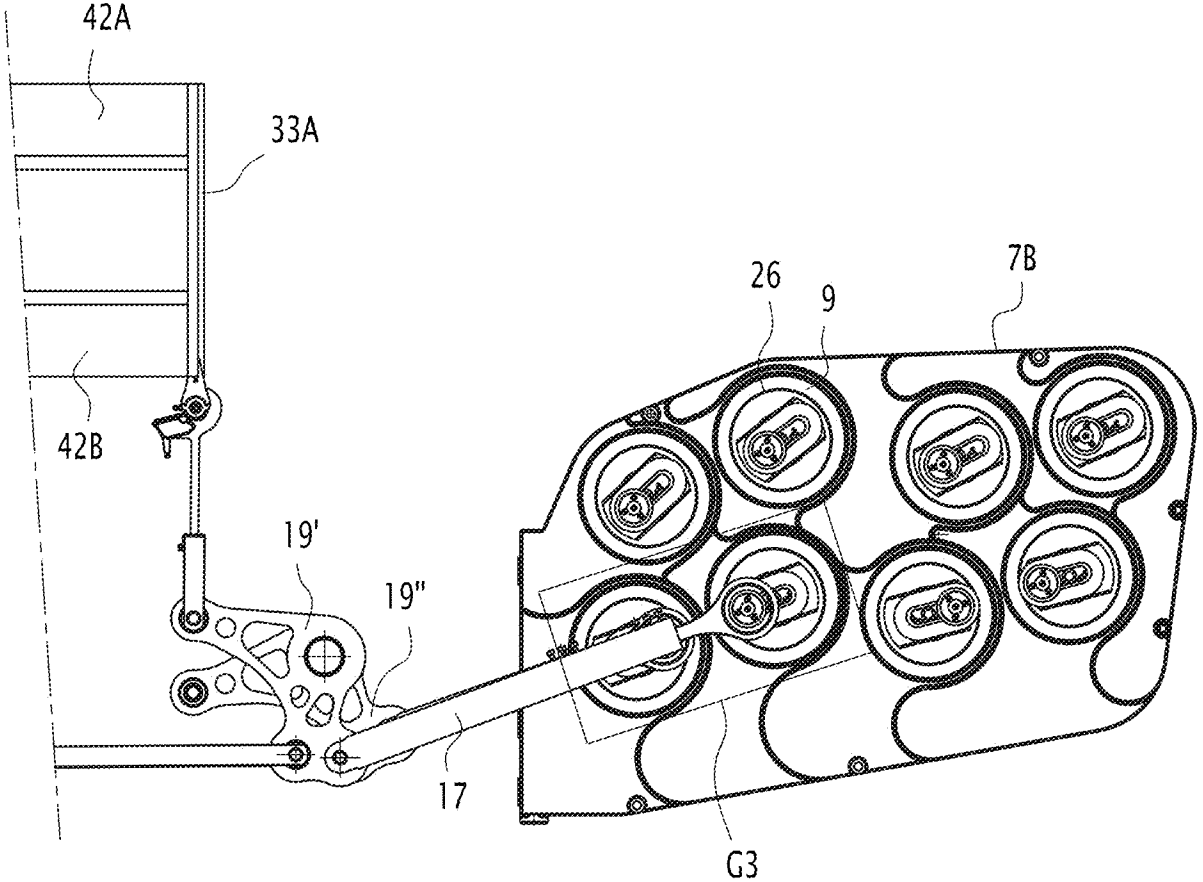
FIG. 10 is a view similar to that of FIG. 1, in which a part of the shedding assembly is omitted and in which a drive lever and a drive connecting rod belonging to another of the shedding machines and driving another heald frame are shown, the drive lever being of a third type.
Figure 11:
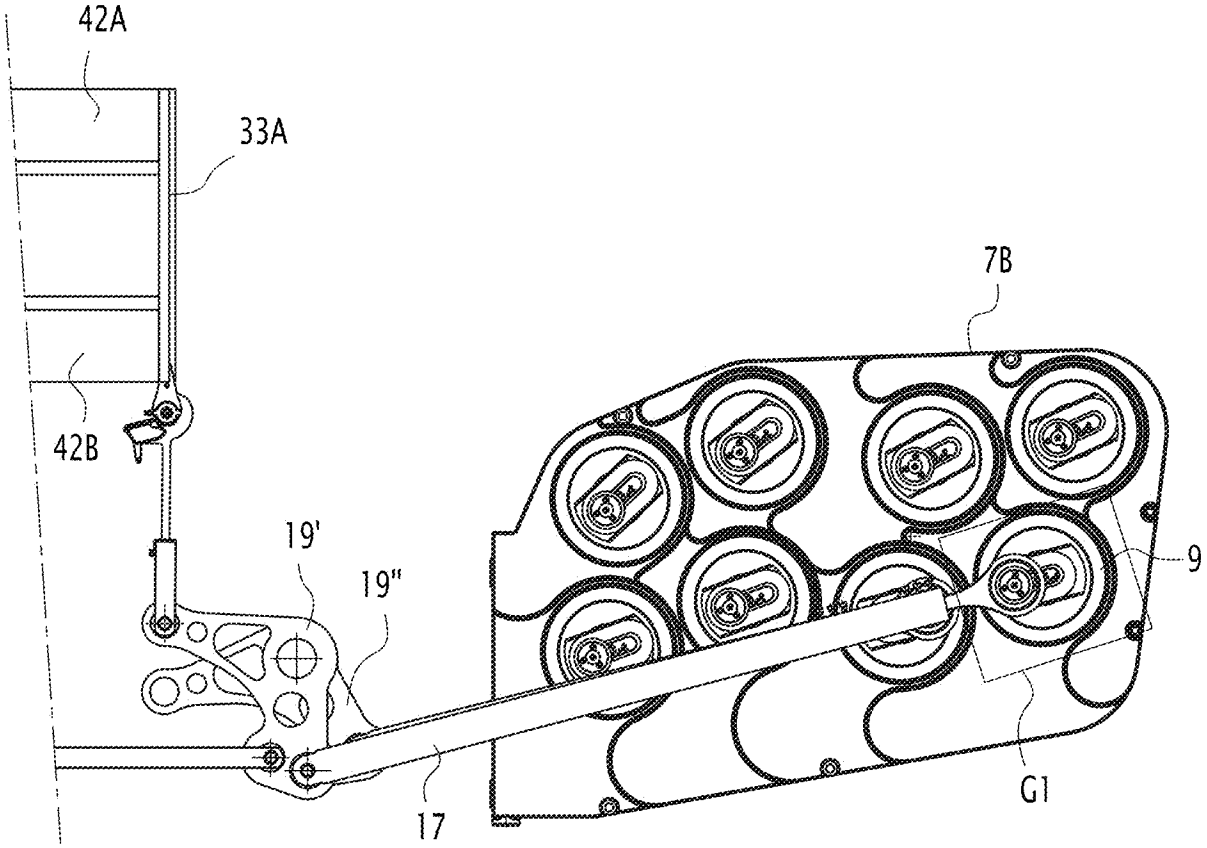
FIG. 11 is a view similar to that of FIG. 1, in which a part of the shedding assembly is omitted and in which a drive lever and a drive connecting rod belonging to another of the shedding machines and driving another heald frame are shown, the drive lever being of a fourth type.
Figure 12:
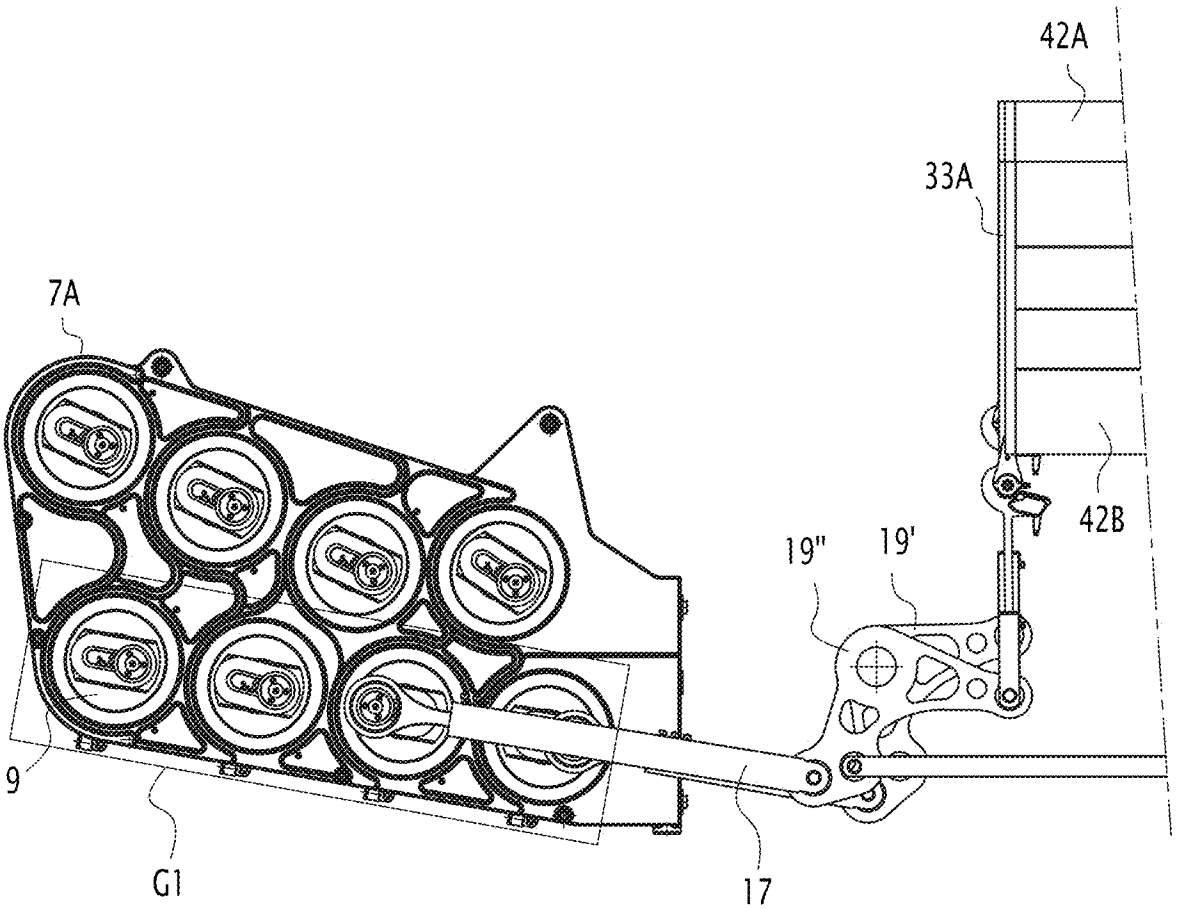
FIG. 12 is a view similar to that of FIG. 1, in which a part of the shedding assembly is omitted and in which a drive lever and a drive connecting rod belonging to another of the shedding machines and driving another heald frame are shown, the drive lever being of a fifth type.
Figure 13:
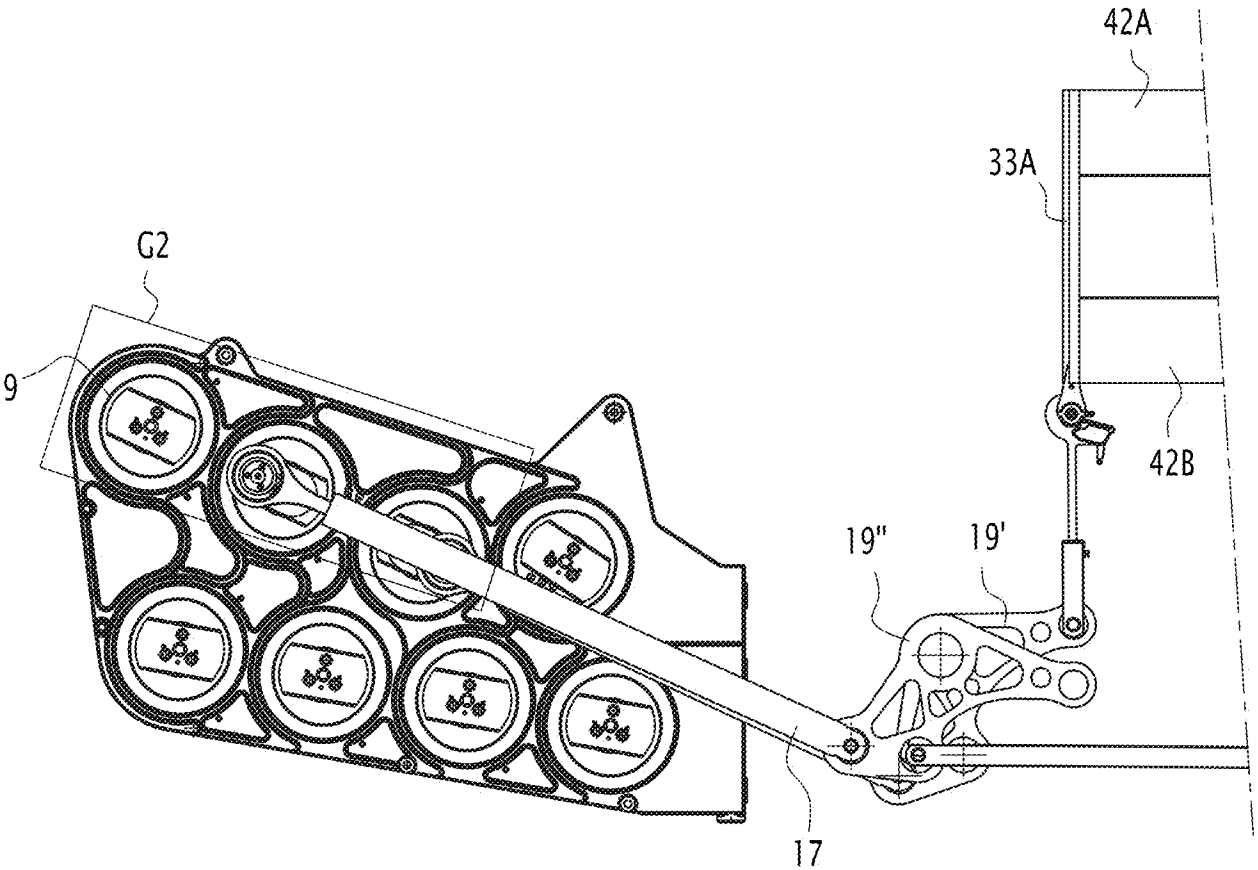
FIG. 13 is a view similar to that of FIG. 1, in which a part of the shedding assembly is omitted and in which a drive lever and a drive connecting rod belonging to another of the shedding machines and driving another heald frame are shown, the drive lever being of a sixth type.
Figure 14:
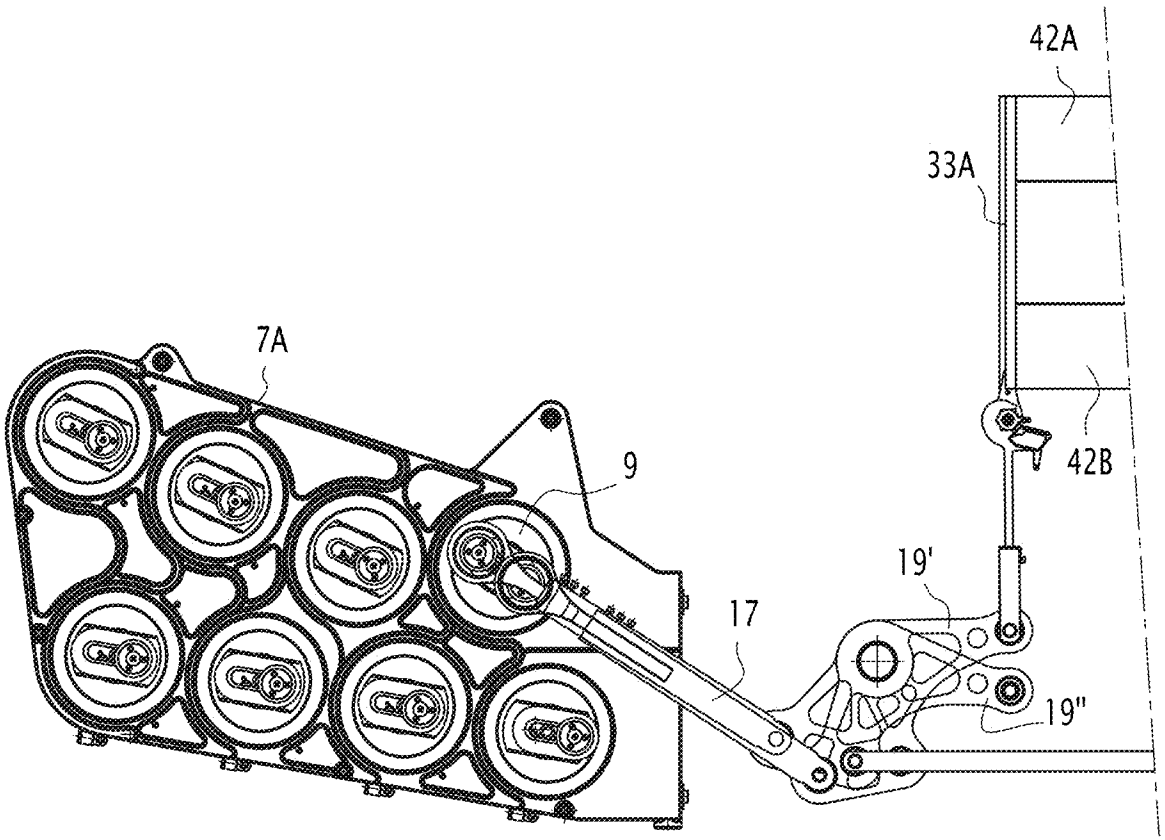
FIG. 14 is a view similar to that of FIG. 1, in which a part of the shedding assembly is omitted and in which a drive lever and a drive connecting rod belonging to another of the shedding machines and driving another heald frame are shown, the drive lever being of a seventh type.

The drive lever 19 can be of several types. Advantageously, the shedding machines 9 of the same group have the same type of the drive lever 19. The levers 19 of the same type are preferably identical or at least have similar dimensions. By way of example, FIGS. 1 and 12 show the lever 19 of the shedding machines 9 of the group G1, FIGS. 2 and 10 show the lever 19 of the shedding machines 9 of the group G3, FIG. 13 shows the lever 19 of a shedding machine 9 of the group G2 and FIG. 14 shows the drive lever 19 of a shedding machine not belonging to any group. The lever arm distance of a shedding machine 9, referred to as d34, is the distance between the first lever axis A3 and the second lever axis A4 of said shedding machine 9, measured along the straight line of the lever arm D34. For each group, the lever arm distance d34 of each machine 9 of the group is equal to the lever arm distance d34 of each other machine 9 of said group, whereby these levers are of the same type. Within a given group, when the machines 9 of the group are in locked configuration with the rotor 29 in one of the reference orientations, then the respective main axes A1, the eccentric axes A2 and the second lever axes A4 of the shedding machine 9 of said group are advantageously coplanar. Thus, for a given type of drive lever 19, the rotors 29 of each of the machines 9 of the same group are in the same angular position when the rotary electric motors 13 are in the locked configuration.

Providing the indexing means, in other words, the indexing pin 89, allows to easily install the motor 13 on the frame 7, in order to ensure that the axes A1, A2 and A4 are coplanar. Indeed, the indexing means 89 ensures that the orientation of the housing 21 and therefore of the stator 23 is correct, given that the locking system is partly mounted on the stator 23, namely the locking pin 79. The stator 23 and the locking system being correctly oriented thanks to the indexing means, the rotor 29 is itself correctly oriented when the machine 9 is in the locked configuration, in order to ensure the aforementioned coplanarity. The indexing means also allows to ensure that the rotor 29 and the stator 23 are optimally positioned relative to the power development of the motor 13 during weaving, considering that accelerations and decelerations of the motor 13 are performed at known angles which are always the same and correspond, for example, to the end positions B3 and H3 of the actuated heald frame 3. The indexing means also allows to ensure that the position sensor 91 is correctly positioned for maximum detection accuracy at these particular angles.

Thanks to these arrangements, the motor is able to stop very precisely at these particular positions, to accelerate efficiently from the particular positions, and the detection that these particular positions have been reached is very accurate. It is provided that the permanent magnets 57 and the winding teeth 35 are advantageously indexed relative to these particular positions, for maximum efficiency.

During shed height adjustment, the adjustment system is put into adjustment configuration by inserting the locking pin 79 into the second notch 82. Thus, the rotor 29 is immobilized in its shed height adjustment orientation. Thanks to indexing by the indexing pin 89, this orientation of the rotor 29 corresponds to the crossover position of the drive lever 19, therefore, to the reference position P3 of the heald frame 3. Then, the drive connecting rod 17 is set to the connecting rod center distance R2 adjustment configuration. By manually moving the heald frame, the length of the drive connecting rod 17 is therefore modified, which is the same as modifying the shed height. Once the adjustment performed, the drive connecting rod 17 is again set to the connecting rod center distance R2 locked configuration. Finally, the locking system is returned to the release configuration by removing the locking pin 79 from the second notch 82, so that the rotary electric motor 13 can rotate again.

When adjusting the shed amplitude, the adjustment system is put into the adjustment configuration by inserting the locking pin 79 into the first notch 81. Thus, the rotor 29 is immobilized in its shed amplitude adjustment orientation. Thanks to indexing by the indexing pin 89, this orientation of the rotor 29, located at 90 degrees relative to the shed height adjustment orientation, corresponds to the high frame position or the low frame position of the drive lever 19, therefore the high position H3 or the low position B3 of the heald frame 3. The adjustment system is then brought into the adjustment position by unscrewing the adjustment screw 77 using the adjustment tool 88. By displacing the heald frame 3 manually or using a dedicated actuator, (not represented, the connecting piece 75 is then slid relative to the base 73, thereby modifying the eccentric distance R1, and therefore the amplitude of the shed. Once the adjustment performed, the adjustment system is returned to the locked position by screwing back the adjustment screw 77 using the adjustment tool 88. Finally, the locking system is returned to the release configuration by removing the locking pin 79 from the first notch 81, so that the rotary electric motor 13 can rotate again.

Figure 15:
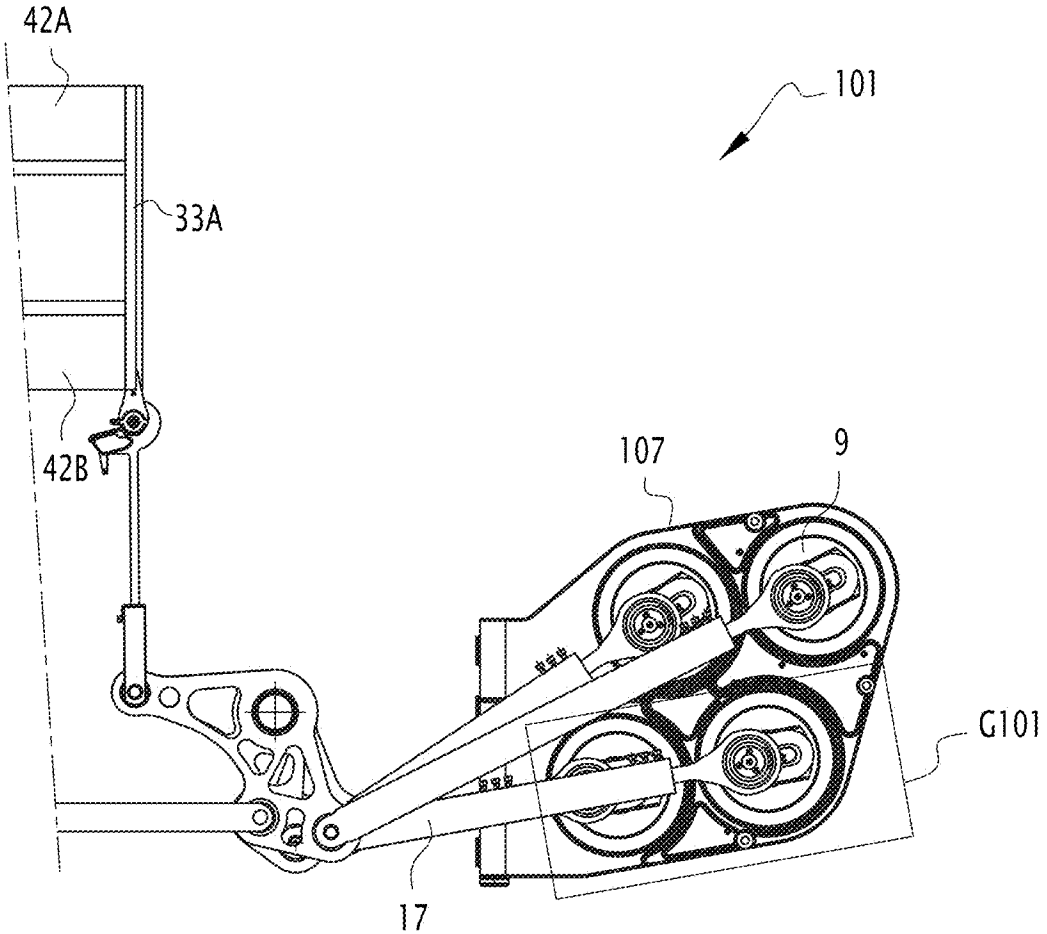
FIG. 15 is a view, similar to that of FIGS. 10 to 14, of a shedding assembly comprising groups of shedding machines, according to a second embodiment of the invention.

FIG. 15 relates to a loom 101 according to a second embodiment of the invention. This loom 101 is identical to the loom 1 of FIGS. 1 to 14 except for the differences mentioned below. The features of the loom 101 that are identical to or function in the same way as those of the loom 1 bear the same reference sign. The modified features carry a reference sign increased by 100. The loom 101 differs from the loom 1 in that it includes only four shedding machines 9 instead of sixteen. The loom 101 comprises a frame 107, which replaces the frame 7, comprising just four locations 11 receiving the four machines 9 respectively.

A group G101 of two shedding machines 9 and two further shedding machines 9 not belonging to any group are provided for here.

Alternatively, it is provided that the loom may comprise from two to thirty shedding machines.

Figure 16:
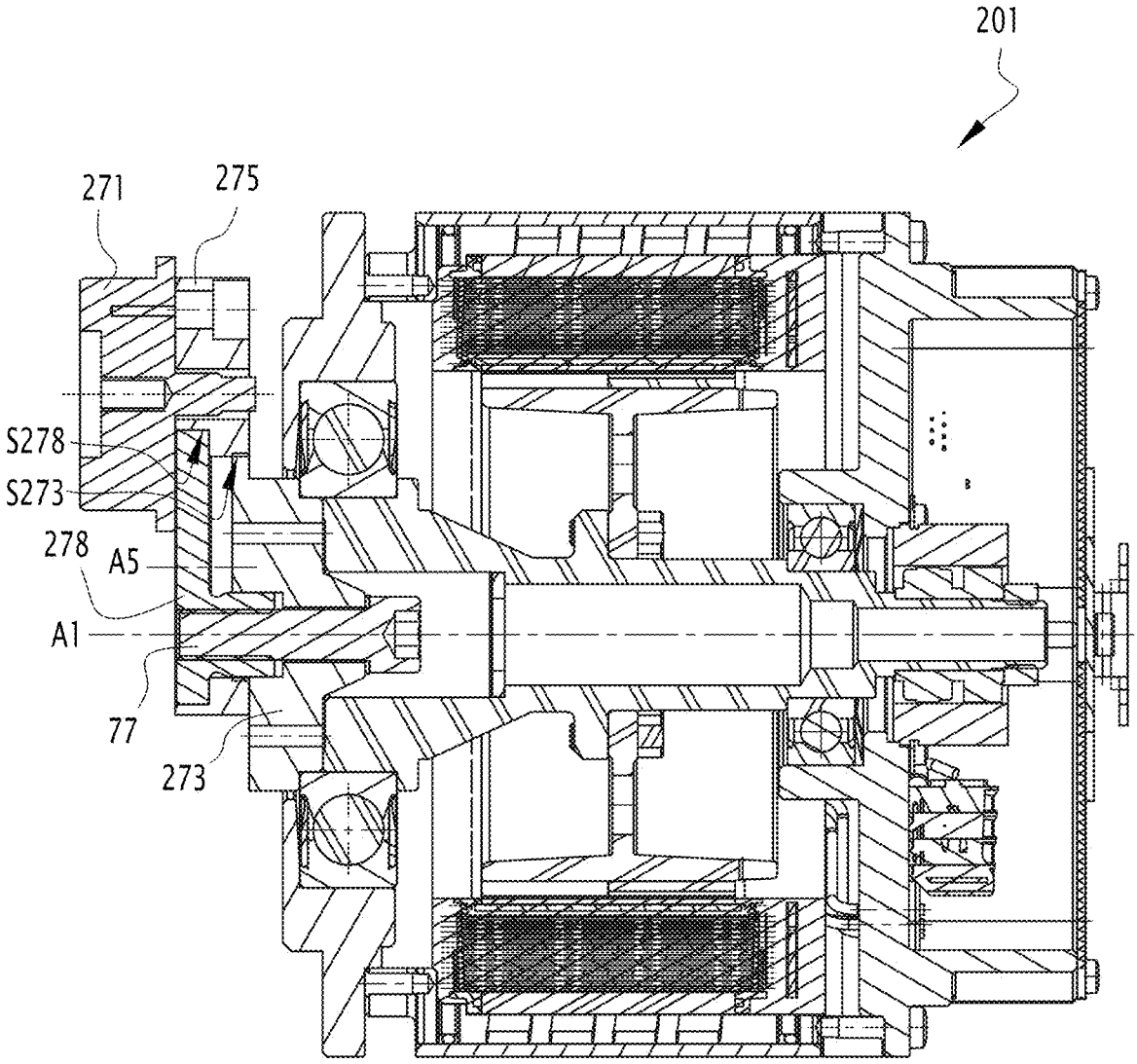
FIG. 16 is a cross-sectional view, similar to that of FIG. 3, of a shedding machine for a loom according to a third embodiment of the invention.
Figure 17:
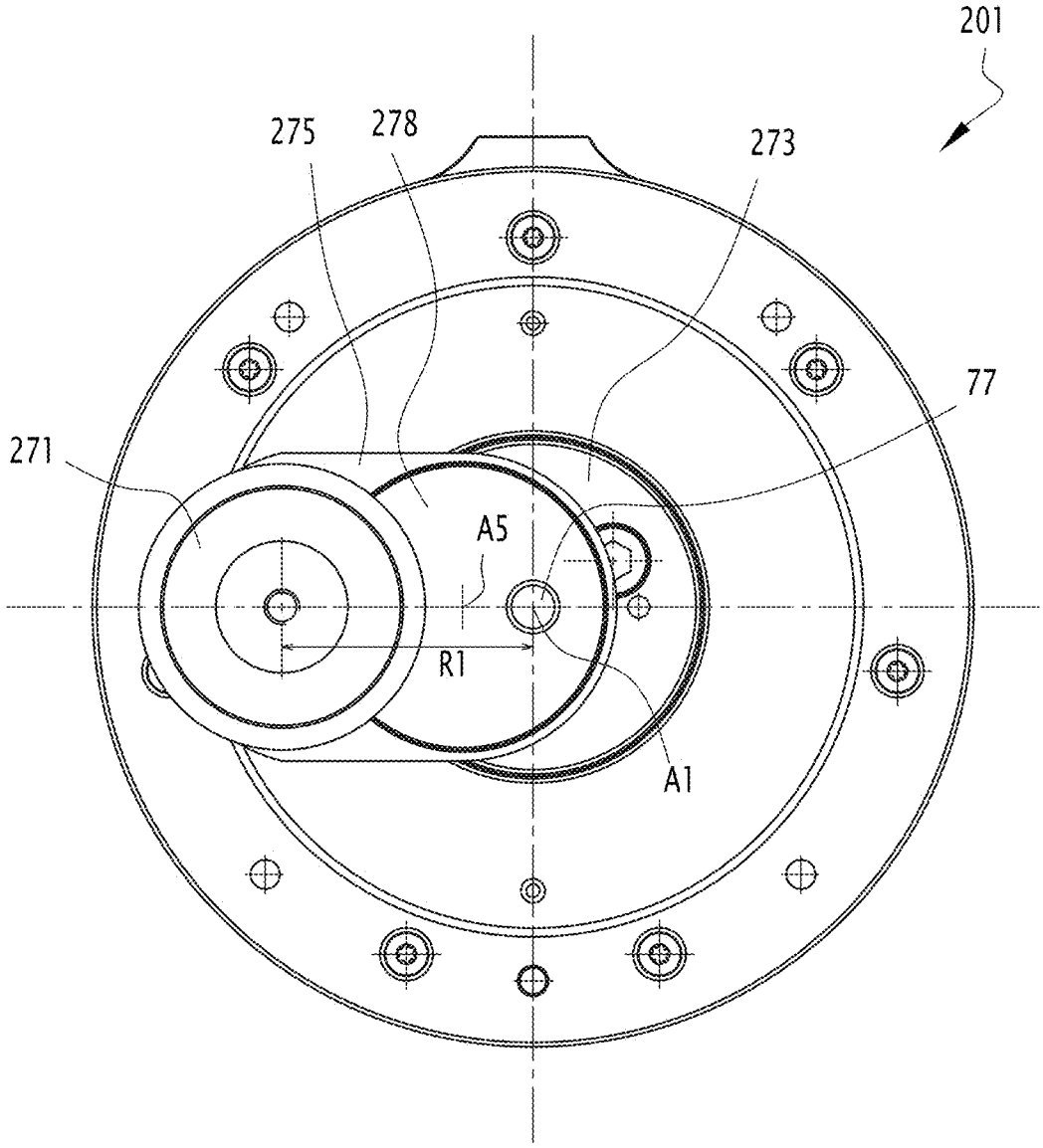
FIG. 17 is a front view, similar to that of FIG. 4, of the shedding machine of FIG. 16.
Figure 18:
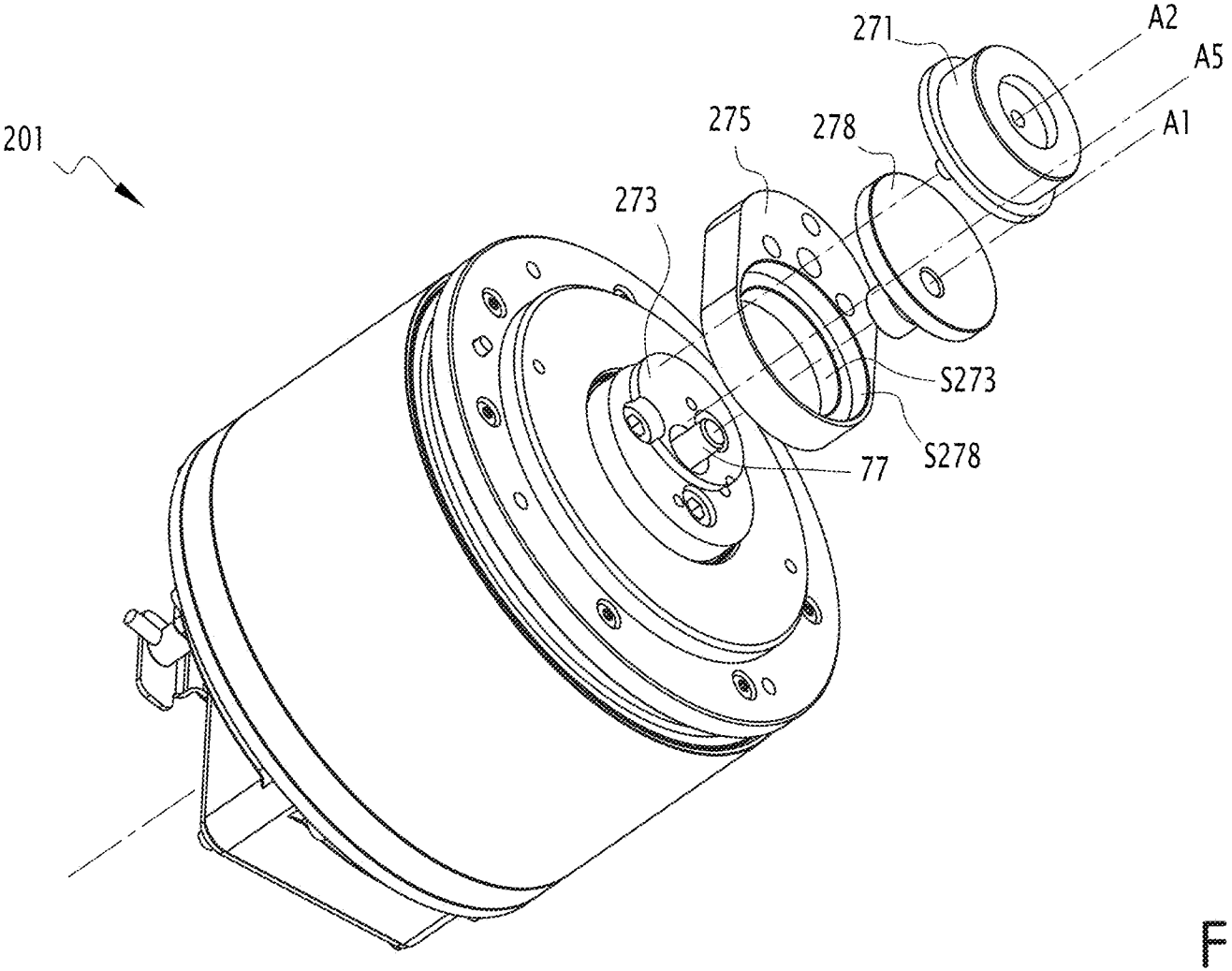
FIG. 18 is an exploded perspective view of the shedding machine of FIGS. 16 and 17.

FIGS. 16 to 18 relate to a loom 201 according to a third embodiment of the invention. This loom 201 is identical to the loom 1 of FIGS. 1 to 14 except for the differences mentioned below. The features of the loom 201 that are identical to or function in the same way as those of the loom 1 bear the same reference sign. The modified features bear a reference sign increased by 200. The loom 201 differs from the loom 1 of the first embodiment in that the connecting piece 275 is no longer slidable relative to the base 273, but these two parts are pivotable relative to each other about a crank axis A5, parallel to the main axis A1.

As is clearly visible in FIG. 18, the connecting piece 275 comprises a through hole defining a first circular shaped internal surface S273, centered on the crank axis A5, complementary to the base 273, and a second internal surface S278, centered on the crank axis A5 and complementary to the clamping nut 278. The first internal surface S273 and the second internal surface S278 form a pivot connection between, on the one hand, the connecting piece 275 and, on the other hand, the base 273 and the clamping nut 278, which are fixed relative to each other about the axis A5.

The crank pin 271, by being fixed to the connecting piece 275 being eccentric relative to the axis A1, defines an eccentric center distance R1 which varies according to the angular position of the connecting piece 275 relative to the base 273.

Rotation of the connecting piece 275 relative to the base 273 is allowed when the adjustment system is in the adjustment configuration, in other words, the nut 278 is slackened by the adjustment screw 77, so that the eccentric distance R1 can be modified. Rotation of the connecting piece 275 relative to the base 273 is locked by tightening the nut 278 with the screw 77 when the adjustment system is in the locked configuration, so that the eccentric distance R1 is fixed.

Figure 19:
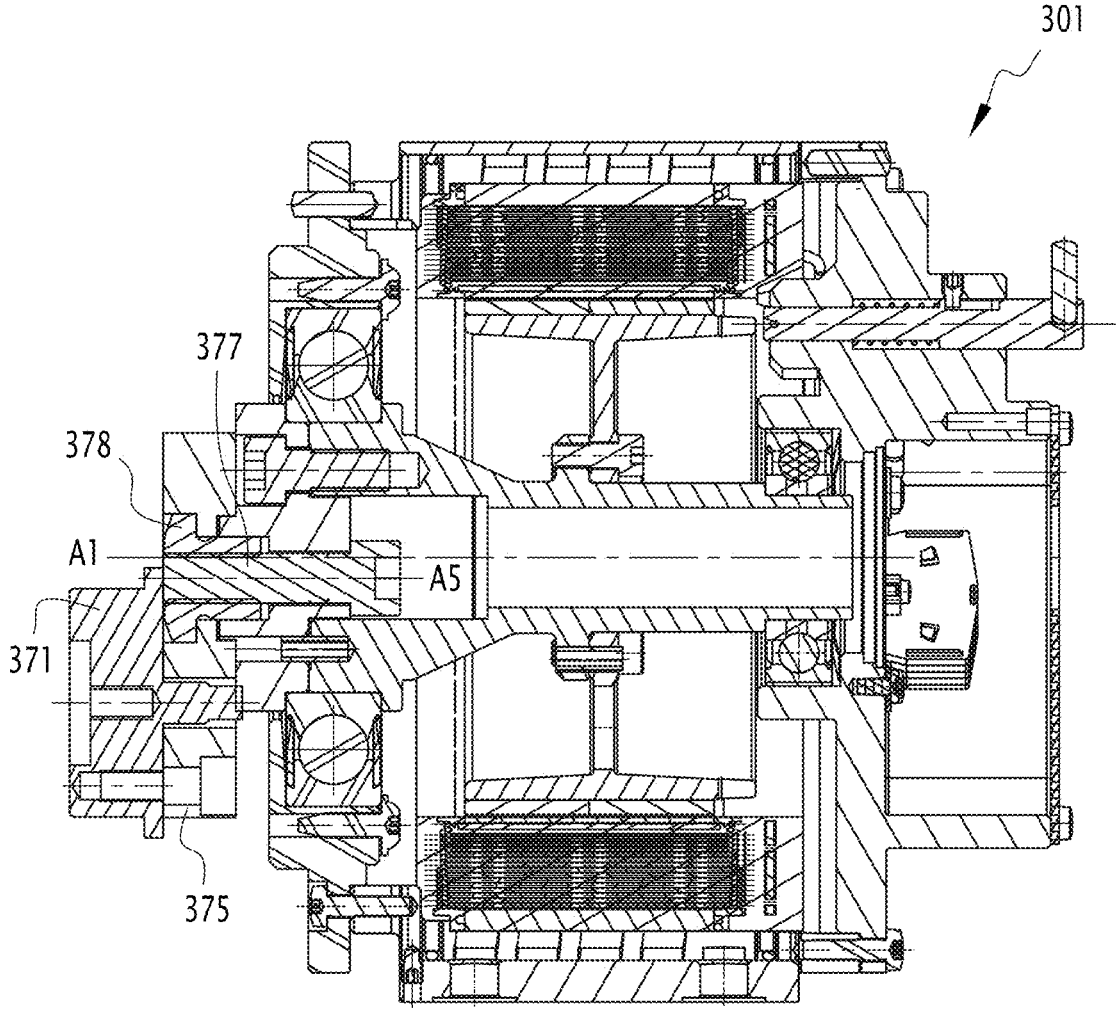
FIG. 19 is a cross-sectional view similar to that of FIG. 3 of a shedding machine according to a fourth embodiment of the invention.
Figure 20:
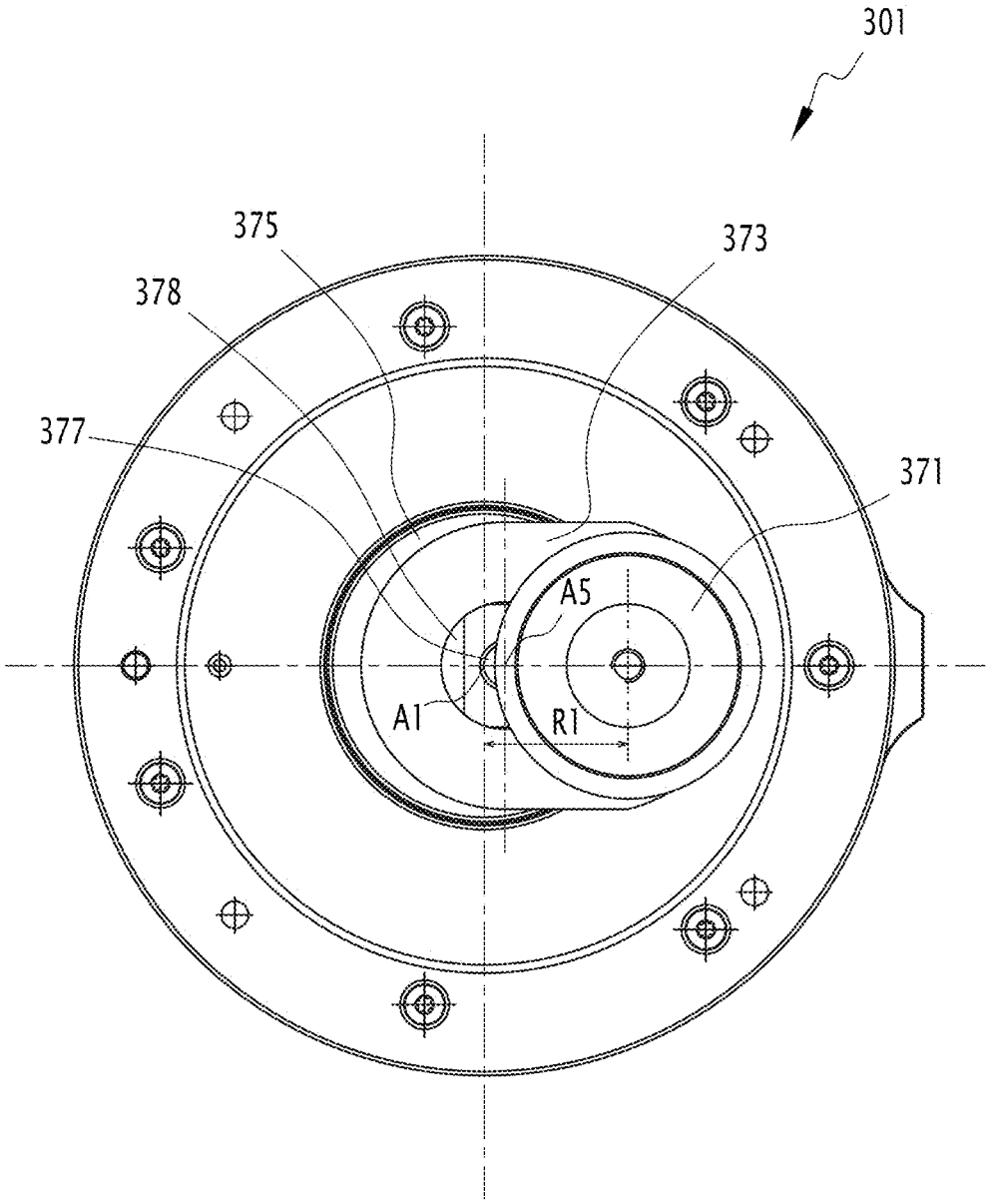
FIG. 20 is a front view, similar to that of FIG. 4, of the shedding machine of FIG. 19.

FIGS. 19 and 20 relate to a loom 301 according to a fourth embodiment of the invention. This loom 301 is identical to the loom 201 of FIGS. 16 to 18 except for the differences mentioned below. The features of the loom 301 that are identical to or function in the same way as those of the loom 201 bear the same reference sign. The modified features carry a reference sign increased by 100. The loom 309 differs from the loom 209 of the third embodiment in that the adjustment screw 377 is eccentric to the axis A1, being centered on the axis A5. The machine 209 also differs from machine 309 in the shape of the clamping nut 378, which is circular in cross-section and centered on the axis A5. As a result, the adjustment screw 377 is coaxial with the second internal surface S278.

Figure 21:
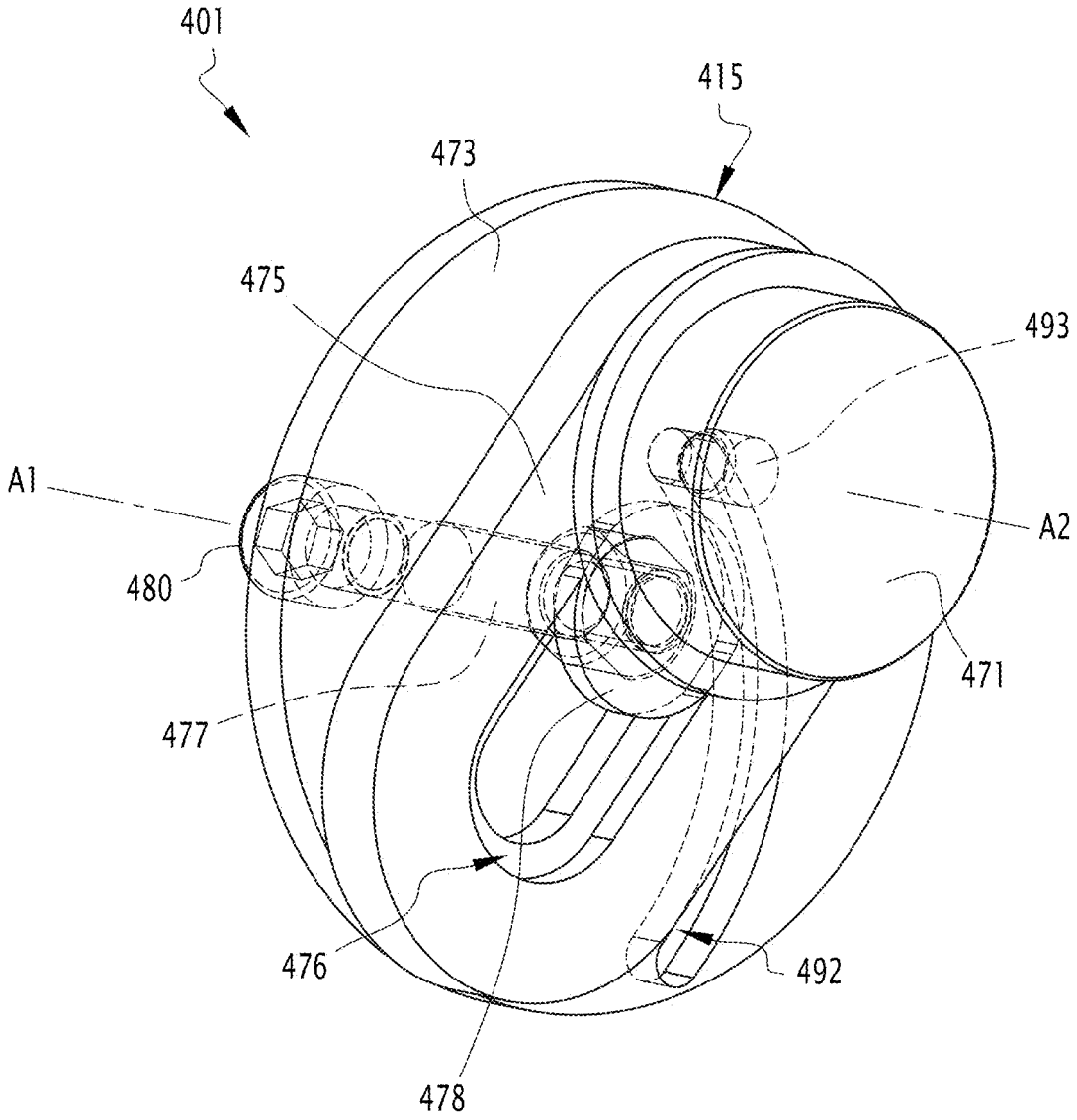
FIG. 21 is a perspective view of a crank belonging to a shedding machine according to a fifth embodiment of the invention.

FIG. 21 relates to a loom 401 according to a fifth embodiment of the invention. This loom 401 is identical to the loom 1 of FIGS. 1 to 14 except for the differences mentioned below. The features of the loom 401 which are identical to or function in the same way as those of the loom 1 bear the same reference sign. The modified features carry a reference sign increased by 400.

In place of the crank 15, the loom 401 comprises a crank 415, ensuring the same function. The crank 415 comprises a base 473, a connecting piece 475 and a crank pin 471.

The base 473 is integral with the rotor shaft 51, to be driven in rotation by the rotor 29 about the axis A1 relative to the stator 23. In the present example, the base 473 forms a radial plate, without the rails provided for the base 73.

The connecting piece 475 is mounted on the base 473. In this embodiment, the connecting piece 475 is a flange with a through axial slide which is able to slide relative to the base 473, radially relative to the axis A1. The connecting piece 475 is in sliding contact with the base plate 473. Unlike the connecting piece 75, the connecting piece 475 can pivot about the axis A1 relative to the base 473, since the connecting piece 475 is not constrained by rails as is the connecting piece 75.

The crank pin 471 and the connecting piece 475 are fixed securely to each other. As with the crank pin 71, the crank pin 471 defines the eccentric axis A2, parallel to the main axis A1 and distant from the main axis A1 by the eccentric center distance R1. As with the crank pin 71, the axis A1 of the crank pin 471 is fixed relative to the connecting piece 475.

The crank 415 is configured so that the pivoting of the connecting piece 475 about the axis A1 relative to the base 473 is subject to sliding of the connecting piece 475 radially relative to the base 473. For this purpose, unlike the base 73, the base 473 advantageously comprises a cam groove 492 and the connecting piece 475 advantageously comprises a follower finger 493, which cooperates with the cam groove 492 by circulating along the cam groove 492, thus forcing the radial translation of the connecting piece 475 to be accompanied by a rotation of the radial piece. To this end, the cam groove 492 follows a spiral path about the main axis A1.

In practice, the cam groove 492 is preferably constituted by a spiral groove recessed into the surface of the base 473. The follower finger 493 is preferably centered on the eccentric axis A2.

The circulation of the follower finger 493 in the cam groove 492 guides the connecting piece 475 according to a displacement relative to the base 473, which includes a radial translation relative to the base 473, allowing the eccentric center distance R1 to be modified.

The connecting piece 475 therefore belongs to an adjustment system allowing the eccentric center distance R1 to be modified, and consequently the shedding amplitude, in a similar way to that described above for the loom 1.

The adjustment system of the loom 401 comprises, as for the loom 1, an adjustment screw 477, visible in FIG. 21, able to selectively allow the displacement of the connecting piece 475 relative to the base 473 and to secure the base 473 to the connecting piece 475. When the adjustment system is in an adjustment configuration, the screw 477 is slackened and the displacement is allowed. Conversely, when the adjustment system is in a locked configuration, the adjusting screw 477 is tightened and the displacement is impossible. Thus, the eccentric center distance R1 can be adjusted if, and only if, the adjusting system is in an adjusting configuration and is fixed if the adjusting system is in a locked configuration. During weaving, the adjustment system is in the locked configuration.

As shown in FIG. 21, it is advantageously provided that the adjusting screw 477 is coaxial with the axis A1 and includes a body which passes through an oblong hole 476 which passes through the connecting piece 475. A clamping nut 478 is provided in the oblong hole 476, into which the screw 477 is screwed. The screw 477 also includes a head 480, by means of which the screw 477 can be rotated. The base 473 and the connecting piece 475 are axially interposed between the nut 478 and the head 480, so that tightening of the screw 477 in the nut 478 presses the connecting piece 475 against the base 473 to prevent the displacement of the connecting piece 475. The head 480 is preferably accessible from the rear of the motor 13 so that it can be actuated.

In this embodiment, the nut 478 guides the pivoting of the connecting piece 475 about the axis A1. The connecting piece 475 is therefore guided in its displacement both by the nut, about the axis A1 fixed relative to the base 473, and by the finger follower 493, about the axis A2 fixed relative to the connecting piece 475.

In the following, the invention is explained with reference to an experimental example, which is by no means limiting.

The experiment consists of evaluating examples of rotary electric motors conforming to the invention, namely the motors B and C, relative to a comparative electric motor A.

The comparative motor A is a commercial motor, the structure of which is described in EP1953276A1, and which presents the characteristics indicated in Table 1 below. The characteristics of the motor A were either determined directly on the motor A (length diameters were measured) or supplied by the manufacturer (rated torque). The moment of inertia was estimated by numerical modeling of the rotor using computer aided design software.

The motor B, according to the invention, is an experimental motor which has not been manufactured, but only numerically modeled. The motor B presents a structure similar to that of the motor 9 of the first embodiment of FIGS. 1 to 15 described above. The motor B presents the characteristics indicated in Table 1 below. The characteristics have all been obtained by numerical modeling (dimensions, moment of inertia) or estimated by calculation (rated torque).

The motor C, according to the invention, is an experimental motor which has been tested on a test bench. The motor C presents a structure conforming to that of the motor 9 in the first embodiment of FIGS. 1 to 15 described above. The motor C presents the characteristics shown in Table 1 below.

In the table below, the ratio R corresponds to the ratio between the external diameter of the stator and the length of the cylindrical part of the rotor. The ratio Kt corresponds to the motor torque constant, expressed as a torque value obtained per unit current I delivered by the power circuit. The torque constant is calculated at a comparable motor speed between the different motors tested, here at 750 rpm, which corresponds to a trade speed of 1500 strokes per minute.

TABLE 1

| Crank drive | Motor A With gearbox | Motor B Without gearbox | Motor C Without gearbox |
|---|---|---|---|
| Presence of a rotor shaft surrounded by a cylindrical rotor part carrying the permanent magnets | NO | YES | YES |
| Moment of inertia of the rotor, excluding the crank, and if a gearbox is present, excluding the gearbox (kg · cm$^2$) | 45 | 95 | 78 |
| Outer stator diameter | 128 | 200 | 180 |
| Length of cylindrical part | 165 | 50 | 60 |
| Ratio R | 0.8 | 4 | 3 |
| Rotor diameter | 80 | 156 | 117 |
| Rated torque, at the rotor (N · m) | 60 | 65 | 65 |
| Kt ratio (N · m/A) at 750 rpm | 3 | 6 | 7 |
| Number of magnet sets | 2 | 2 | 2 |
| Number of permanent magnets per set | 12 | 40 | 30 |
| Number of slots | 15 | 48 | 36 |

The motor C develops a ratio Kt=C/I=65 N·M/9.2 A=7 N·m/A, while the motors A and B are known to develop a ratio Kt of 3 Nm/A and 6 Nm/A respectively at 750 rpm. Achieving such a high motor torque constant corresponds to the use of a highly efficient motor.

The motor A presents axially elongated proportions, with a small outer stator diameter and a particularly long cylindrical part. The motor A is therefore particularly bulky in the longitudinal direction. It is noted that the motor A itself presents a particularly low moment of inertia. However, the rated torque of the rotor is low in view of the application, so it is necessary to provide the gearbox. The small diameter limits the ability of the motor to deliver high torque at low current. The presence of the gearbox for the motor A significantly increases the moment of inertia, reduces mechanical efficiency and increases the overall length, which is already high due to the motor itself.

The motor B is relatively short and radially more cumbersome, with a large outer stator diameter and a relatively small length of the cylindrical part. The motor B is radially bulky, which imposes constraints on the design of the shedding assembly for a loom, to arrange several motors side by side. The fact of providing a large outer stator diameter and a large outer rotor diameter allows to provide for a high number of permanent magnets around the cylindrical part and a high number of slots for the stator, with a high number of windings. The motor B thus provides sufficient rated torque for the application, so there is no need for a gearbox. Thanks to the presence of the rotor shaft surrounded by the cylindrical part, it can be seen that the motor B itself has a moderately high moment of inertia, despite its large rotor diameter. The moment of inertia of the motor B is suitable for the application, especially as there is no need to provide a gearbox.

The motor C is of balanced proportions, which facilitates the design of the shedding assembly, which is not too cumbersome, and allows several motors to be easily arranged side by side. The fact of providing a relatively large outer stator diameter and a large outer rotor diameter allows for a relatively high number of permanent magnets around the cylindrical part and a relatively high number of slots for the stator, with a relatively high number of windings. The motor B thus provides sufficient rated torque for the application, so there is no need for a gearbox. Surprisingly, the moment of inertia is particularly low, which is very advantageous for the application, especially as no gearbox is required.

What is claimed is:

1. A shedding machine for actuating a heald frame of a loom according to a stroke in reciprocating translation according to a frame axis, the shedding machine comprising:

a rotary electric motor, comprising:

a housing, centered on a main axis of the rotary electric motor and configured to be integral with a machine frame of the loom, a stator, integral with the housing, a rotor, arranged in the stator and comprising a cylindrical part, centered on the main axis and comprising an outer peripheral wall, a first bearing, arranged in a first plane, perpendicular to the main axis, on a front side of the rotary electric motor, and a second bearing, arranged in a second plane, perpendicular to the main axis, at a rear side of the rotary electric motor, the first bearing and the second bearing guiding the rotor in rotation relative to the stator about the main axis;

a crank, integral with the rotor and comprising a crank pin defining an eccentric axis, parallel to the main axis and distant from the main axis by an eccentric center distance;

a drive lever, which is configured to pivot about a first lever axis relative to the machine frame, to actuate the heald frame, the first lever axis being fixed relative to, and parallel to, the main axis; and a drive connecting rod, comprising:

a first end, coupled to the crank pin and being pivotable about the eccentric axis relative to the crank pin, and a second end, coupled to the drive lever and being pivotable about a second lever axis relative to the drive lever, the second lever axis being parallel to the first lever axis;

wherein:

the stator comprises:

winding laminations, surrounding the main axis and extending radially between an outer stator diameter and an inner stator diameter centered on the main axis, the winding laminations forming winding teeth distributed around the main axis, directed toward the main axis and delimiting between them stator slots, which extend parallel to the main axis, and electrical windings, each electrical winding being wound around a plurality of the winding teeth and being received in the stator slots; and the rotor comprises:

a rotor shaft, centered on the main axis, surrounded by the cylindrical part of the rotor and being integral with the cylindrical part of the rotor and the crank, and permanent magnets, arranged on the outer peripheral wall of the cylindrical part and being distributed about the main axis, each permanent magnet comprising a respective outer surface, the outer surfaces facing the winding teeth and being on a rotor circle, centered on the main axis and defining a rotor diameter; and a ratio of the outer stator diameter relative to a length of the cylindrical part, measured parallel to the main axis without passing the permanent magnets, is between 2.0 and 4.0.

2. The shedding machine according to claim 1, wherein:

the rotor comprises a first set of permanent magnets, comprising 12 to 40 permanent magnets, equally distributed about the main axis; and the stator comprises 24 to 48 slots, equally distributed around the main axis.

3. The shedding machine according to claim 2, wherein:

the rotor comprises a second set of permanent magnets, offset relative to the first set of permanent magnets according to the main axis, each permanent magnet of the second set of permanent magnets being adjacent to one of the permanent magnets of the first set of permanent magnets, according to the main axis; and each permanent magnet of the first set of permanent magnets is angularly offset, about the main axis, relative to the permanent magnet of the second set of permanent magnets adjacent thereto, by an angle of 0.5 to 5 degrees.

4. The shedding machine according to claim 1, wherein the outer stator diameter measures between 160 and 200 mm.

5. The shedding machine according to claim 1, wherein the rotor is designed so that a moment of inertia of the rotor is less than 100 $kg \cdot cm^2$.

6. The shedding machine according to claim 1, wherein the shedding machine comprises an electrical cabinet, comprising an electrical power circuit configured to electrically supply the rotary electric motor and in that the rotary electric motor develops a rated torque of between 30 and 100 Nm.

7. The shedding machine according to claim 6, wherein the electrical power circuit delivers a supply current of intensity I to the rotary electric motor which develops a torque ratio per unit current I of between 6.5 and 8 N·m/A, when a speed of rotation of the rotor is maintained at 750 rpm.

8. The shedding machine according to claim 1, wherein:
each winding tooth comprises:
a tooth head, delimited by the inner stator diameter,
a tooth root, delimited by the outer stator diameter, and
a tooth body, which extends perpendicularly to the main axis, which connects the tooth head to the tooth root and which presents a generally rectangular shape when projected in the first plane, each tooth body having a length, measured radially relative to the main axis, of between 19 and 25 mm; and
each electrical winding forms three layers of wire around the winding tooth around which said electrical winding is wound.

9. The shedding machine according to claim 1, wherein the rotor shaft comprises a single part which extends so as to connect the first plane and the second plane.

10. The shedding machine, according to claim 1, wherein:
the rotor comprises a disk, extending perpendicularly to the main axis, comprising recesses distributed about the main axis and a central bore, by means of which the disk is fitted onto the rotor shaft,
the cylindrical part is integral with the rotor shaft and the disk and surrounds the disk.

11. The shedding machine according to claim 10, wherein the rotor shaft comprises:
a centering wall, cooperating with the central bore to center the disk on the rotor shaft; and
a collar, extending radially to the main axis and being arranged between the first plane and the second plane, the disk being fixed to the collar by means of at least one screw parallel to the main axis.

12. The shedding machine according to claim 1, wherein:
the crank comprises:
a base, integral with the rotor shaft, and
a connecting piece, integral with the crank pin and mounted on the base; and
the shedding machine comprises an adjustment system, which comprises locking means, configured to:
allow adjustment of the eccentric center distance, by relative displacement between the base and the connecting piece, in an adjustment configuration of the adjustment system, and
securing the base to the connecting piece, in a locked configuration of the adjustment system.

13. The shedding machine according to claim 12, wherein:
the base comprises a cam groove, defining a spiral about the main axis; and
the connecting piece comprises a follower finger circulating along the cam groove to guide the connecting piece relative to the base when the adjustment system is in the adjustment configuration and thus vary the eccentric center distance.

14. The shedding machine according to claim 12, wherein the connecting piece and the base are pivotable relative to one another about a crank axis parallel to the main axis, when the adjustment system is in the adjustment configuration.

15. The shedding machine according to claim 1, wherein:
a rotation stroke without change of direction of the rotor about the main axis corresponds to an oscillation stroke of the drive lever about the first lever axis, the oscillation stroke including a high frame orientation, a crossover orientation and a low frame orientation of the drive lever, the crossover orientation being median between the high frame orientation and the low frame orientation; and
the rotary electric motor comprises locking means, which allow:
a locked configuration, wherein the locking means immobilizes the rotor relative to the stator about the main axis, selectively according to several predetermined reference orientations, of which:
a shed amplitude adjustment orientation, in which the drive lever is in the high frame orientation or in the low frame orientation, and
a shed height adjustment orientation, at 90 degrees relative to the shed amplitude adjustment orientation and wherein the drive lever is in the crossover orientation; and
a release configuration, wherein the locking means allows the rotation of the rotor about the main axis relative to the stator.

16. The shedding machine according to claim 15, wherein the locking means comprises:
a locking pin, movable relative to the stator according to a direction parallel to the main axis;
a first notch, belonging to the rotor and cooperating with the locking pin in the locked configuration, to immobilize the rotor in the shedding amplitude adjustment orientation; and
a second notch, belonging to the rotor and cooperating with the locking pin in the locked configuration, to immobilize the rotor in the shed height adjustment orientation.

17. The shedding machine according to claim 15, wherein the shedding machine is arranged such that, when the rotary electric motor is in the locked configuration with the rotor in the shed amplitude adjustment orientation, then the main axis, the eccentric axis and the second lever axis are substantially coplanar.

18. The shedding machine according to claim 15, wherein the shedding machine comprises:
a front flange, integral with the housing and comprising a circular flange, configured to cooperate with the machine frame, so that the housing can be positioned on the machine frame;
means for fixing the rotary electric motor to the machine frame, for fixing the rotary electric motor to the machine frame when the circular flange cooperates with the machine frame; and
an indexing means, which is distinct from the fixing means and which requires that, when the circular flange cooperates with the machine frame, the housing is positioned so that:
the drive lever is in the high frame orientation or in the low frame orientation when the rotor is in the shed amplitude adjustment orientation in the locked configuration, and
the drive lever is in the crossover orientation when the rotor is in the shed height adjustment orientation in the locked configuration.

19. The shedding machine according to claim 15, wherein:
the first lever axis and the second lever axis are connected by a straight line of a lever arm perpendicular to the second lever axis;
the eccentric axis and the second lever axis are connected by a straight line of the connecting rod perpendicular to the second lever axis and defining a connecting rod-lever angle with the straight line of the lever arm; and
the connecting rod-lever angle is 97 degrees, plus or minus 2 degrees, when the drive lever is in the crossover orientation.

20. The shedding assembly, comprising a group of shedding machines according to claim 1 and wherein:

each shedding machine of the group defines a lever arm distance, measured between the first lever axis and the second lever axis;

the lever arm distance of each shedding machine of the group is equal to the lever arm distance of each other shedding machine of the group; and when the shedding machines of the group are in a locked configuration with the rotor in one of reference orientations, then the respective main axes, the eccentric axes and second lever axes of the shedding machines of the group are coplanar.

* * * * *